US008757391B2

(12) United States Patent
Kiyono et al.

(10) Patent No.: US 8,757,391 B2
(45) Date of Patent: Jun. 24, 2014

(54) GARBAGE SEPARATION AND RECOVERY MACHINE FOR BEACH CLEANING

(75) Inventors: Koji Kiyono, Wako (JP); Jun Nakajima, Wako (JP); Tatsuo Masuda, Wako (JP); Yasuji Hashimoto, Wako (JP); Takanori Okuma, Wako (JP); Tatsuhiko Asano, Wako (JP); Tomohiro Nishida, Wako (JP); Masato Nakata, Wako (JP); Hiroyuki Uchida, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/698,956

(22) PCT Filed: Nov. 25, 2010

(86) PCT No.: PCT/JP2010/006869

§ 371 (c)(1),
(2), (4) Date: Nov. 19, 2012

(87) PCT Pub. No.: WO2011/158312

PCT Pub. Date: Dec. 22, 2011

(65) Prior Publication Data

US 2013/0062260 A1 Mar. 14, 2013

(30) Foreign Application Priority Data

Jun. 17, 2010 (WO) ..... PCT/JP2010/004032

(51) Int. Cl.
*B07B 1/22* (2006.01)

(52) U.S. Cl.
USPC ..... 209/288; 209/369; 209/421; 171/109; 171/112; 171/126; 171/128; 171/129

(58) Field of Classification Search
USPC ..... 209/288, 364, 369, 421; 171/109, 112, 171/126–129
See application file for complete search history.

(56) References Cited

U.S. PATENT DOCUMENTS 401,285 A * 4/1889 Lorrie ..... 171/108
406,096 A * 7/1889 Hoover ..... 209/369

(Continued)

FOREIGN PATENT DOCUMENTS

JP 57-58709 A 4/1982
JP 3-21423 U 3/1991

(Continued)

*Primary Examiner* — Jeffrey Shapiro
(74) *Attorney, Agent, or Firm* — Birch, Stewart, Kolasch & Birch, LLP

(57) ABSTRACT

A garbage separation and recovery machine for beach cleaning that has mobility and can perform a garbage separation and recovery work according to the situation is provided. The garbage separation and recovery machine has a drum type sieve body (54) that is freely rotatably secured to a vehicle body frame (51) towed by a vehicle, a driving gear (92) that is freely rotatably supported by the vehicle body frame (51) and secured to an axle (52) to which right and left wheels are secured, and a mechanism portion (91) for transmitting the driving force of the driving gear (92) to the drum type sieve body (54). The mechanism portion (91) has a gear switching mechanism (95) for performing a switching operation between an automatic rotation mode in which the drum type sieve body (54) is rotated by the rotational force of the wheels (53) and a manual rotation mode in which the drum type sieve body (54) is released from the rotational force of the wheel (53) and allowed to be manually freely rotatable.

18 Claims, 11 Drawing Sheets

(56) References Cited

U.S. PATENT DOCUMENTS

| | | | | | |
|---|---|---|---|---|---|
| 437,679 | A | * | 10/1890 | Colgrove | 171/27 |
| 1,051,552 | A | * | 1/1913 | Burgdorf | 171/108 |
| 1,545,331 | A | * | 7/1925 | Kaapke et al. | 171/58 |
| 2,744,739 | A | * | 5/1956 | Evans et al. | 171/129 |
| 2,760,322 | A | * | 8/1956 | Johnson | 171/97 |
| 2,856,013 | A | * | 10/1958 | Evans | 171/9 |
| 4,276,043 | A | * | 6/1981 | Eddy et al. | 493/160 |
| 4,312,750 | A | * | 1/1982 | Braun et al. | 209/291 |
| 4,416,334 | A | * | 11/1983 | Bouillon | 171/27 |
| 4,440,637 | A | * | 4/1984 | Smit et al. | 209/241 |
| 4,927,528 | A | * | 5/1990 | Doppstadt | 209/31 |
| 4,993,498 | A | * | 2/1991 | Fresnel | 171/25 |
| 5,084,991 | A | * | 2/1992 | Cronk, Jr. | 37/142.5 |
| 5,480,098 | A | * | 1/1996 | Doppstadt | 241/101.76 |
| 5,490,928 | A | * | 2/1996 | Tanii | 210/380.3 |
| 6,019,227 | A | * | 2/2000 | May, III | 209/284 |
| 7,833,303 | B1 | * | 11/2010 | Higgins | 55/400 |
| 2010/0071918 | A1 | | 3/2010 | Asao et al. | |
| 2013/0220896 | A1 | * | 8/2013 | Ito et al. | 209/235 |

FOREIGN PATENT DOCUMENTS

| | | | |
|---|---|---|---|
| JP | 3026390 | U | 7/1996 |
| JP | 2001-164534 | A | 6/2001 |
| JP | 2007-303087 | A | 11/2007 |
| JP | 2010-77601 | A | 4/2010 |

* cited by examiner

GARBAGE SEPARATION AND RECOVERY MACHINE FOR BEACH CLEANING

TECHNICAL FIELD

The present invention relates to a garbage separation and recovery machine for beach cleaning.

BACKGROUND ART

There is known a garbage withdrawing station that enables withdrawal of garbage collected by a beach cleaner towed by a vehicle to withdraw garbage from sand while the beach cleaner is made to ride on the garbage withdrawing station (see Patent Document 1, for example). In this Patent Document 1, a trailer having a pair of right and left wheels at both the sides of the lower portion of the vehicle body frame thereof is prepared, and a beach cleaner and a garbage withdrawing station are mounted on the trailer so that both the beach cleaner and the garbage withdrawing station can be jointly transported together with each other. Furthermore, a drum type separation machine for separating mud and sand from each other by using a rotating drum is known (see Patent Document 2, for example).

PRIOR ART DOCUMENT

Patent Document

Patent Document 1: JP-A-2007-303087

Patent Document 2: Japanese Utility Model Registration No. 3,026,390

SUMMARY OF THE INVENTION

Problem to be Solved by the Invention

With respect to the garbage collected at the garbage withdrawing station, sand is required to be screened out from the garbage by manually sieving the garbage or the like, and much labor is required to perform a separation work of the sand from the garbage. Furthermore, withdrawal of garbage and the separation work must be manually performed on rough terrain where it is impossible to withdraw garbage by a beach cleaner, and more labor is required. A conventional drum type separation machine is large in size, and does not have mobility, so that it cannot withdraw and separate garbage while moving on a sea coast as rough terrain. Furthermore, it is impossible to change the driving of the drum in accordance with the separation condition.

The present invention has been implemented in view of the foregoing situation, and has an object to provide a garbage separation and recovery machine for beach cleaning that has mobility and can perform a garbage separation work according to the situation.

Means of Solving the Problem

In order to attain the above object, according to the present invention, a garbage separation and recovery machine for beach cleaning that has a vehicle body frame (51) towed by a vehicle and right and left wheels (53) secured to an axle (52) supported freely rotatably by the vehicle body frame (51), and separates sand and garbage from each other, comprises: a drum type sieve body (54) that is freely rotatably secured to the vehicle body frame (51); a driving gear (92) secured to the axle (52); and a transmission mechanism (91) that transmits driving force of the driving gear (92) to the drum type sieve body (54), wherein the transmission mechanism (91) has a switching unit (95) that is configured to perform a switching operation between an automatic rotation mode in which the drum type sieve body (54) is rotated by rotational force of the wheel (53) and a manual rotation mode in which the drum type sieve body (54) is released from the rotational force of the wheel (53) and allowed to be manually freely rotatable.

According to this construction, the garbage separation and recovery machine is provided with the drum type sieve body that is freely rotatably secured to the vehicle body frame, the driving gear secured to the axle and the transmission mechanism that transmits driving force of the driving gear to the drum type sieve body, and the transmission mechanism has the switching unit that is configured to perform the switching operation between the automatic rotation mode in which the drum type sieve body is rotated by rotational force of the wheel and the manual rotation mode in which the drum type sieve body is released from the rotational force of the wheel and allowed to be manually freely rotatable. Accordingly, the garbage separation and recovery machine is high in mobility, and can perform garbage withdrawal and separation while moving on seacoast as an irregular terrain, and perform a garbage separation work conformed with the situation by mode switching.

In the above construction, the garbage separation and recovery machine may further comprise a clutch pipe (96) provided to the vehicle body frame (51) in parallel to the axle (52), a driven gear (93) that is freely slidably provided to the clutch pipe (96) and engaged with/disengaged from the driving gear (92), and fitting pieces (94) that are provided on the outer periphery of the drum type sieve body (54) and engaged with the driven gear (93) at a position where the driven gear (93) is engaged with the driving gear (92), wherein the automatic rotation mode and the manual rotation mode are switched to each other by sliding the driven gear (93) to an engagement position where the driven gear (93) is engaged with the driving gear (92) and a disengagement position where the driven gear (93) is disengaged from the driving gear (92) while retracted from the engagement position with the driving gear (92). According to the above construction, the garbage separation work can be performed with a simple engagement structure of the driving gear secured to the axle, the driven gear mounted freely slidably on the clutch pipe provided in parallel to the axle and the fitting pieces provided on the outer periphery of the drum type sieve body, and the automatic rotation mode in which the drum type sieve body is rotated by the rotational force of the wheel and the manual rotation mode in which the drum type sieve body is released from the rotational force of the wheel and allowed to be freely rotatable manually can be switched to each other by sliding the driven gear through the switching means. Accordingly, the garbage separation work can be performed according to the situation with the simple structure.

In the above construction, the fitting pieces (94) may be spaced from one another in the peripheral direction of the drum type sieve body (54) and project outwards in the radial direction from the outer periphery of the sieve body, the driving gear (92) may have a plurality of rod-like members (92B) that are spaced from one another in the peripheral direction of the gear and extend in the axial direction of the axle (53) from the outer periphery of the gear, and the driven gear (93) may be engaged with projection ends of the fitting pieces (94) and the rod-like members (92B). According to this construction, the driven gear and each rod-like member can be easily engaged with each other, the engagement and the disengagement can be smoothly switched to each other, and the engagement state can be kept even under running on an irregular terrain such as seacoast or the like. In addition, sand easily drops from the rod-like members, and hardly stays at the engagement portion, so that abrasion can be suppressed.

Furthermore, in the above construction, the drum type sieve body (54) may be disposed at the upper side of the axle (52) so that the rotational center of the drum type sieve body (54) is displaced from the axle (52) in a front-and-rear direction, and the rotational center of the driven gear (93) may be provided between the rotational center of the drum type sieve body (54) and the axle (52) in side view. According to this construction, the driven gear can be disposed by using the empty space between the drum type sieve body and the axle, and the garbage separation and recovery machine can be miniaturized in the up-and-down direction.

In the above construction, the switching means (95) may have an operation lever (100) that is supported by the vehicle body frame (51) so as to be freely rotatable in an axle direction with an intermediate portion as a fulcrum, joined to the driven gear (93) at a tip portion thereof and turns in the axle direction to slide the driven gear (93). According to this construction, the mode switching operation can be performed by moving the driven gear with a simple structure.

In the above construction, the garbage separation and recovery machine may further comprise a sliding member (161) for sliding the clutch pipe (96) in accordance with an operation of the operation lever (100), and an urging member (175) that is provided between the sliding member (161) and the driven gear (93) to urge the driven gear (93) to the engagement position. According to this construction, when the driven gear is engaged with an engagement target, the driven gear can be quickly and easily engaged by the urging force when the driven gear is in phase with the engagement target.

Furthermore, in the above construction, the driven gear (93) may be engaged with one of the driving gear (92) and each of the fitting pieces (94), and then engaged with the other with keeping an engagement state with the one. According to this construction, the driven gear can be more easily and quickly engaged with the driving gear and the fitting piece.

In the above construction, the vehicle body frame (51) may have a joint (55) secured to a trailer hitch (11) at a front end thereof, a main frame (61) that passes from the joint (55) through a width center of the vehicle body, extends linearly backwards and further extends to a lower rear side to support the axle (52) at a rear end thereof, a sieve body support frame (62) that is supported at an upper side of the main frame (61) and supports the drum type sieve body (54) through a roller (71) so that the drum type sieve body (54) is freely rotatable, and a shield body (63) that is supported by the sieve body support frame (62) and covers the surrounding of the drum type sieve body (54). According to this construction, the drum type sieve body can be supported through the sieve body support frame above the main frame and the drum type sieve body can be covered by the shield body while the main frame is miniaturized in the vehicle width direction and the up-ad-down direction. Accordingly, the garbage separation and recovery machine can be constructed with a compact frame structure.

Furthermore, in the above construction, the main frame (61) may have a front portion (61A) extending linearly from the joint (55) backwards, and a rear portion (61B) that extends from a rear end of the front portion (61A) to a rear lower side and supports the axle (52) at a rear end thereof, the front portion (61*a*) may be formed to be longer than the rear portion (61B), and the driven gear (93) may be disposed to be overlapped with the wheel (53) between the rear portion (61B) and the drum type sieve body (54) in side view. According to this construction, the driven gear can be disposed compactly by using the space between the main frame and the drum type sieve body, and the driven gear can be guarded by the rear portion and the wheel. In addition, the height of the joint with respect to the axle can be secured, and thus the variation of the attitude of the garbage separation and recovery machine due to the difference in height of the trailer hitch of the towing vehicle can be suppressed.

Still furthermore, in the above construction, the garbage separation and recovery machine may further comprise a support frame (65) that supports the sieve body support frame (62) at an upper side of the main frame (61), wherein the support frame (65) has a front support frame (66) that extends upwards from the front portion (61A) of the main frame (61) and supports the sieve body support frame (62). According to this construction, the sieve body support frame can be supported at a position near to the main frame, and the support stiffness of the drum type sieve body can be secured.

Still furthermore, in the above construction, the support frame (65) may have a rear support frame (67) that extends upwards from a rear end of the main frame (61) and supports the sieve body support frame (62), and the driven gear (93) may be disposed behind the front support frame (66) and in front of the rear support frame (67). According to this construction, the front and rear sides of the driven gear can be guarded by the front support frame and the rear support frame.

Effect of the Invention

According to the present invention, the garbage separation and recovery machine is provided with the drum type sieve body that is freely rotatably secured to the vehicle body frame, the driving gear secured to the axle and the transmission mechanism that transmits driving force of the driving gear to the drum type sieve body, and the transmission mechanism has the switching unit that is configured to perform the switching operation between the automatic rotation mode in which the drum type sieve body is rotated by rotational force of the wheel and the manual rotation mode in which the drum type sieve body is released from the rotational force of the wheel and allowed to be manually freely rotatable. Accordingly, the garbage separation and recovery machine has mobility, and can perform the garbage separation work according to the situation.

Furthermore, the garbage separation and recovery machine further comprise the clutch pipe provided to the vehicle body frame in parallel to the axle, the driven gear that is engaged with/disengaged from the driving gear, and the fitting pieces that are engaged with the driven gear at the position where the driven gear is engaged with the driving gear, and the automatic rotation mode and the manual rotation mode are switched to each other by sliding the driven gear to the engagement position of the driven gear with the driving gear and the disengagement position of the driven gear from the driving gear with retracting the driven gear from the engagement position with the driving gear. Accordingly, the garbage separation work can be performed according to the situation with a simple structure.

Furthermore, the fitting pieces are spaced from one another in the peripheral direction of the drum type sieve body and project outwards in the radial direction from the outer periphery of the sieve body, the driving gear has a plurality of rod-like members that are spaced from one another in the peripheral direction of the gear and extend in the axial direction of the axle from the outer periphery of the gear, and the driven gear is engaged with projection ends of the fitting pieces and the rod-like members. Accordingly, the switching operation of the engagement/disengagement can be smoothly performed, the engagement state can be kept under running on an irregular terrain such as seacoast and sand is difficult to stay at the engagement portion, so that abrasion can be suppressed.

The drum type sieve body is disposed at the upper side of the axle so that the rotational center of the drum type sieve body is displaced from the axle in a front-and-rear direction, and the rotational center of the driven gear is provided between the rotational center of the drum type sieve body and the axle in side view. Therefore, the driven gear can be disposed by using the empty space between the drum type sieve body and the axle, and the garbage separation and recovery machine can be miniaturized in the up-and-down direction.

The switching means has the operation lever that is supported by the vehicle body frame so as to be freely rotatable in an axle direction with the intermediate portion as a fulcrum, joined to the driven gear at a tip portion thereof and turns in the axle direction to slide the driven gear. According to this construction, the mode switching operation can be performed by moving the driven gear with a simple structure.

Furthermore, the main frame (61) may have a front portion (61A) extending linearly from the joint (55) backwards, and a rear portion (61B) that extends from a rear end of the front portion (61A) to a rear lower side and supports the axle (52) at a rear end thereof, the front portion (61*a*) may be formed to be longer than the rear portion (61B), and the driven gear (93) may be disposed to be overlapped with the wheel (53) between the rear portion (61B) and the drum type sieve body (54) in side view. According to this construction, the driven gear can be disposed compactly by using the space between the main frame and the drum type sieve body, and the driven gear can be guarded by the rear portion and the wheel. In addition, the height of the joint with respect to the axle can be secured, and thus the variation of the attitude of the garbage separation and recovery machine due to the difference in height of the trailer hitch of the towing vehicle can be suppressed. sliding member for sliding the clutch pipe (96) in accordance with an operation of the operation lever, and the urging member that is provided between the sliding member and the driven gear to urge the driven gear to the engagement position. When the driven gear is engaged with the engagement target, the driven gear can be quickly and easily engaged by the urging force when the driven gear is in phase with the engagement target.

Furthermore, the driven gear is engaged with one of the driving gear and each of the fitting pieces, and then engaged with the other with keeping an engagement state with the one. Accordingly, the driven gear can be more easily and quickly engaged with the driving gear and the fitting piece.

Furthermore, the vehicle body frame has the joint secured to the trailer hitch at the front end thereof, the main frame that passes from the joint through the width center of the vehicle body, extends linearly backwards and further extends to the lower rear side to support the axle at the rear end thereof, the sieve body support frame that is supported at the upper side of the main frame and supports the drum type sieve body through the roller so that the drum type sieve body is freely rotatable, and the shield body that is supported by the sieve body support frame (62) and covers the surrounding of the drum type sieve body. Accordingly, the garbage separation and recovery machine can be constructed with a compact frame structure.

Furthermore, the main frame (61) has the front portion extending linearly from the joint backwards, and the rear portion that extends from the rear end of the front portion to the rear lower side and supports the axle at the rear end thereof, the front portion is formed to be longer than the rear portion, and the driven gear is disposed to be overlapped with the wheel between the rear portion and the drum type sieve body in side view. Accordingly, the driven gear can be disposed compactly, and the driven gear can be guarded by the rear portion and the wheel. In addition, the height of the joint with respect to the axle can be secured, and thus the variation of the attitude of the garbage separation and recovery machine due to the difference in height of the trailer hitch of the towing vehicle can be suppressed.

Still furthermore, the garbage separation and recovery machine further comprises the support frame that supports the sieve body support frame at the upper side of the main frame, and the support frame has the front support frame that extends upwards from the front portion of the main frame and supports the sieve body support frame. Accordingly, the sieve body support frame can be supported at a position near to the main frame, and the support stiffness of the drum type sieve body can be secured.

Still furthermore, the support frame has the rear support frame that extends upwards from the rear end of the main frame and supports the sieve body support frame, and the driven gear is disposed behind the front support frame and in front of the rear support frame. Accordingly, the front and rear sides of the driven gear can be guarded by the front support frame and the rear support frame.

BEST MODES FOR CARRYING OUT THE INVENTION

Embodiments according to the present invention will be described hereunder with reference to the drawings. In the description, the front, rear, right, left, upper and lower directions are defined as the directions with respect to the vehicle body unless described otherwise.

<First Embodiment>

Figure 1:
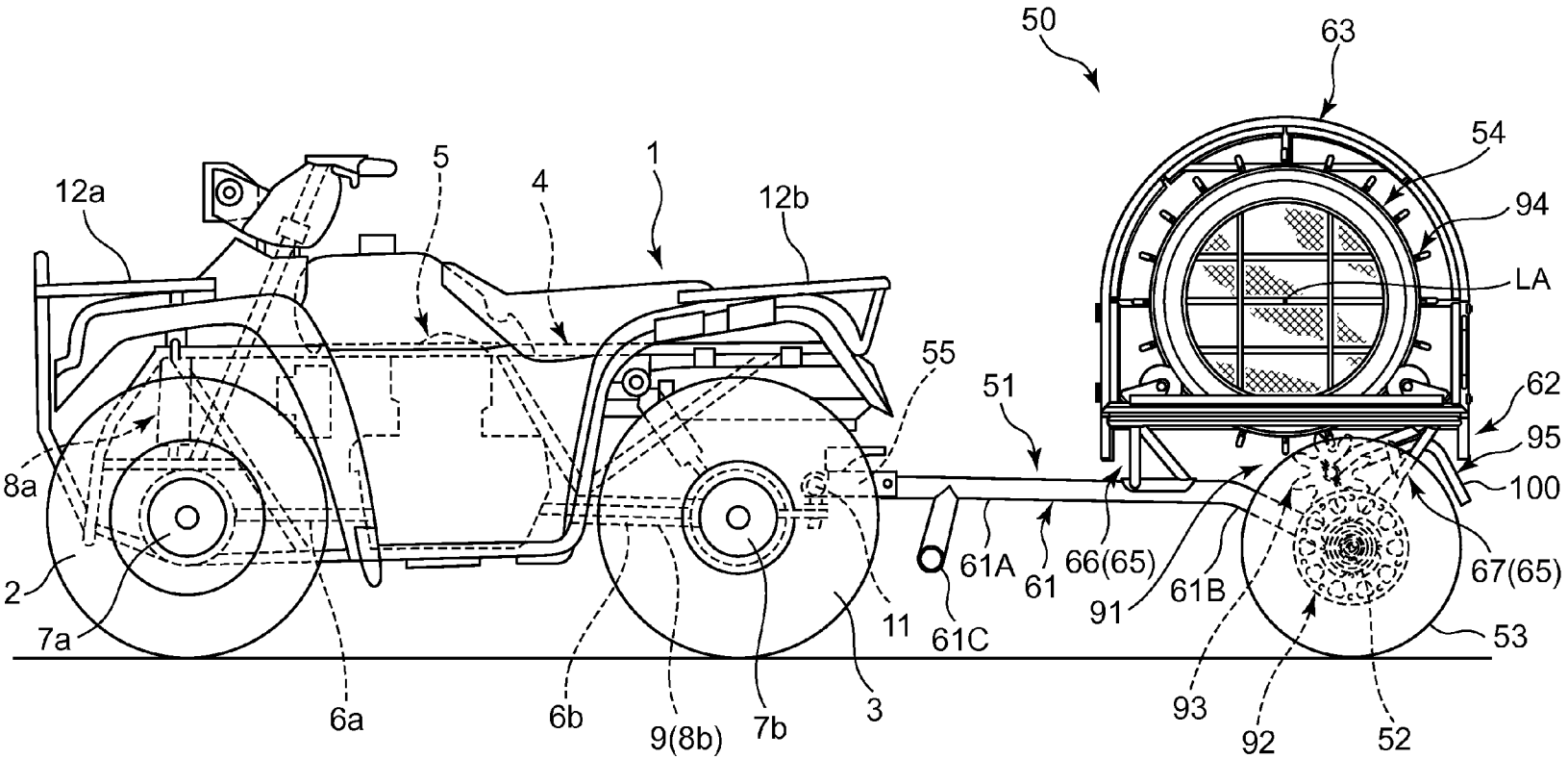
FIG. 1 is a left side view showing a towing state of a garbage separation and recovery machine for beach cleaning according to a first embodiment.

FIG. 1 is a left view showing a towing state of a garbage separation and recovery machine for beach cleaning according to a first embodiment.

As shown in FIG. 1, the garbage separation and recovery machine for beach cleaning (hereinafter referred to as garbage separation and recovery machine) 50 is constructed as a towing type which can be towed by a vehicle 1.

The vehicle 1 is a compact vehicle suitable to run on the sand such as a beach or the like. It is configured as a so-called ATV (All Terrain Vehicle) that has right and left front wheels 2 and right and left rear wheels 3 as low-pressure balloon tires having relatively large diameters at the front and rear sides of the compact and light vehicle body thereof, and enhances running performance mainly on rough terrain by securing large ground clearance. The vehicle body frame 4 of the vehicle 1 is configured to have a box-shaped structure which is long in the front-and-rear direction at a center portion in the vehicle width direction, and an engine 5 as a motor for the vehicle 1 is mounted at the substantially center portion of the vehicle body frame 4.

The engine 5 is a water-cooled type single-cylinder engine, and outputs the rotational driving force of a crank shaft to front and rear propeller shafts 6*a* and 6*b* through a gear engagement type transmission. The rotational driving force output to the front and rear propeller shafts 6*a* and 6*b* are output to the right and left front wheels 2 or the right and left rear wheels 3 through front and rear decelerating devices 7*a* and 7*b*, respectively.

Here, the vehicle 1 is a so-called semi-automatic vehicle in which the gear ratio of the transmission can be changed by electrically-powered operation. For example, the gear ratio can be changed, for example through a centrifugal clutch by only an operation of a change button or the like without executing clutch operation. The vehicle 1 as described above is also more suitable to run under a larger running load or at a constant speed as compared with a vehicle having a belt type transmission.

The vehicle 1 is not limited to the semi-automatic vehicle, but it may be an automatic transmission vehicle in which the gear ratio is automatically changed.

The right and left front wheels 2 are suspended to the front portion of the vehicle body frame 4 through an independent suspension type front suspension 8*a*, and the right and left rear wheels 3 are suspended to the rear portion of the vehicle body frame 4 through a swing arm type rear suspension 8*b*, for example. A trailer hitch 11 for towing the garbage separation and recovery machine or the like is provided to the rear end portion of the swing arm 9 of the rear suspension 8*b*.

In FIG. 1, reference numeral 12*a* represents a front carrier supported to the front portion of the vehicle body frame 4, and reference numeral 12*b* represents a rear carrier supported to the rear portion of the vehicle body frame 4.

Next, the garbage separation and recovery machine 50 will be described.

Figure 2:
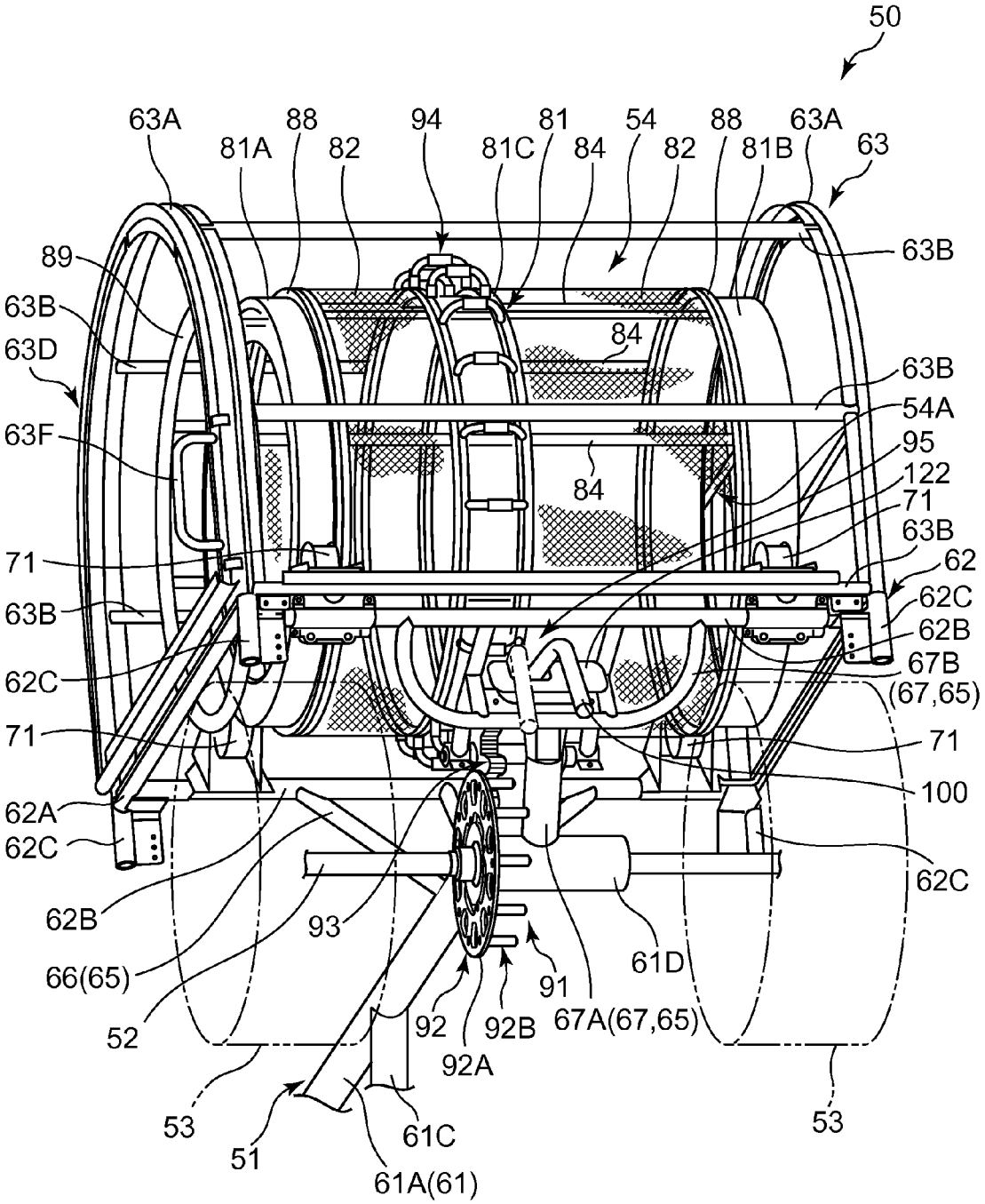
FIG. 2 is a perspective view of the garbage separation and recovery machine which is taken from the rear side.
Figure 3:
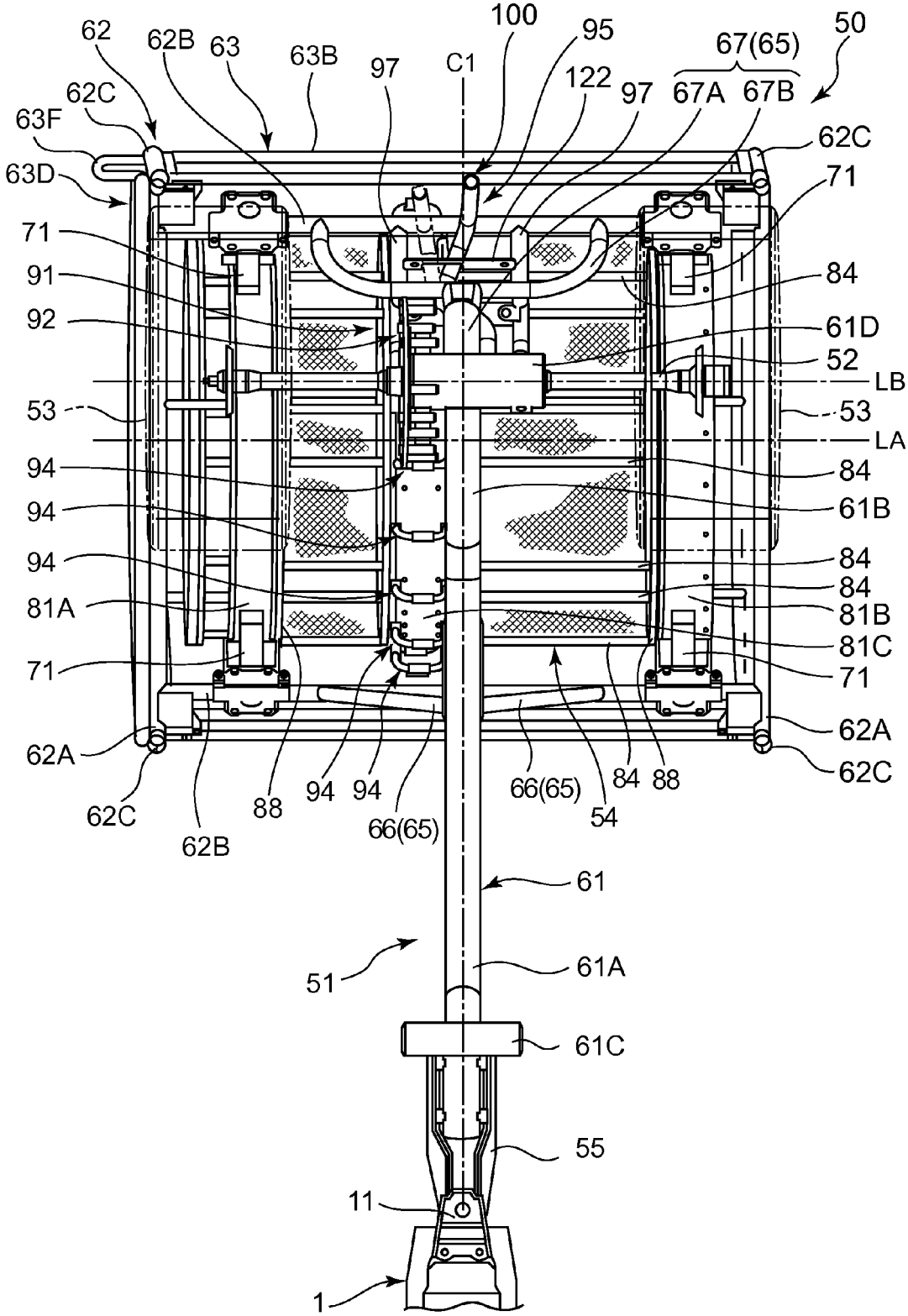
FIG. 3 is a view of the garbage separation and recovery machine which is taken from the lower side.
Figure 4:
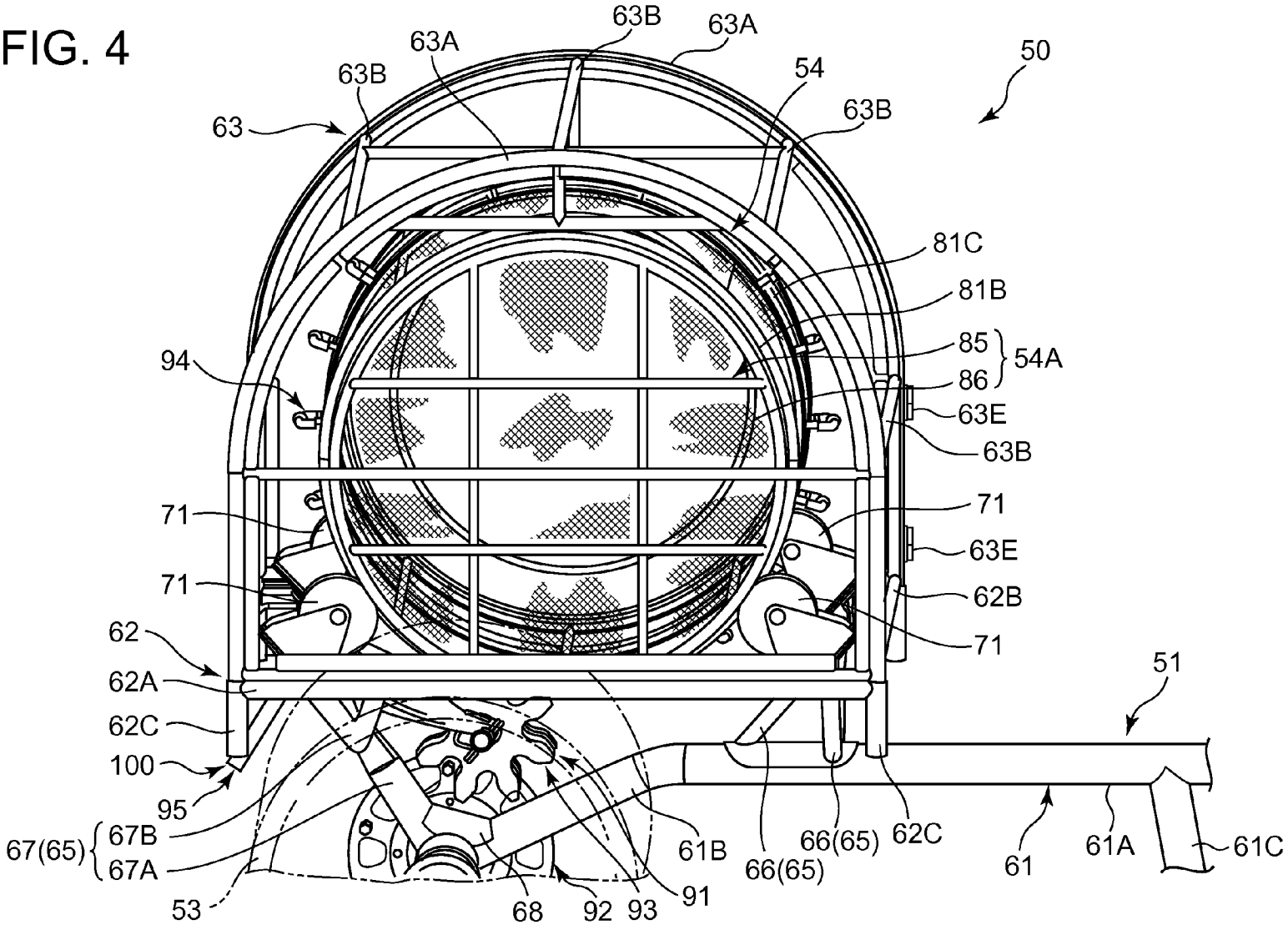
FIG. 4 is a view of the garbage separation and recovery machine which is taken form the right side.
Figure 5:
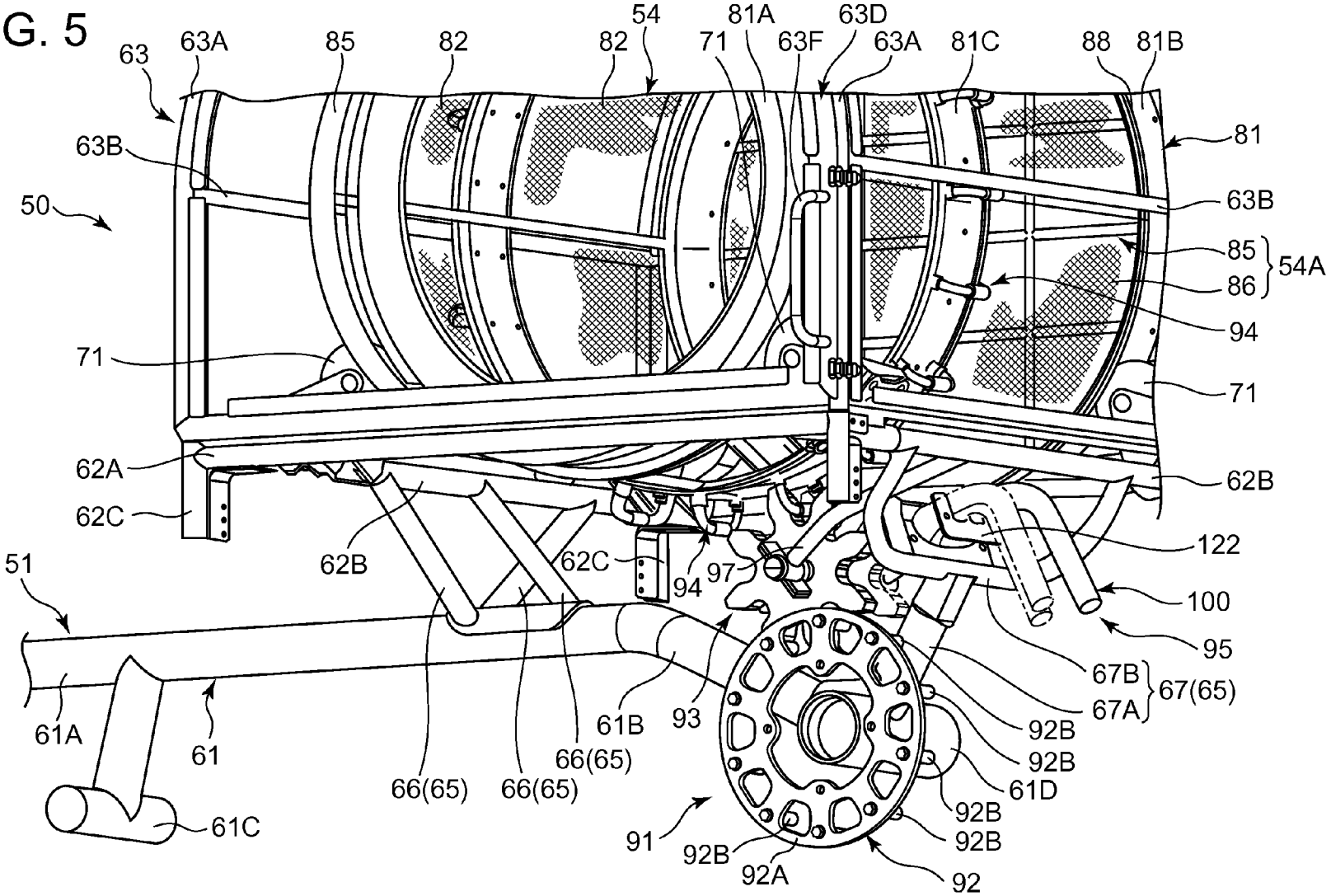
FIG. 5 is a perspective view of the garbage separation and recovery machine which is taken from the left side under the state that the wheels are detached.

FIG. 2 is a perspective view of the garbage separation and recovery machine 50 which is taken from the rear side, FIG. 3 is a view taken from the lower side, FIG. 4 is a view taken from the right side and FIG. 5 is a perspective view of the garbage separation and recovery machine which is taken from the left side when wheels 53 are detached from the garbage separation and recovery machine 50. In FIG. 3, reference character C1 represents the center in the width of the garbage separation and recovery machine 50, reference character LA represents the axis line (rotational center) of a drum type sieve body 54 and reference character LB represents the axis line (rotational center) of an axle 52.

As shown in FIG. 1, the garbage separation and recovery machine 50 is a machine which has the vehicle body frame 51 towed by the vehicle 1, the pair of right and left wheels 53 secured to the vehicle body frame 51 through the axle 52 (see FIG. 2) and the drum type sieve body 54 secured to the vehicle body frame 51, and functions as a mobile type sand separating machine for separating sand from garbage withdrawn by a publicly known beach cleaner.

A joint (which is also called as a hitch coupler) 55 which can be secured to the trailer hitch 11 is provided to the front end portion of the vehicle body frame 51 of the garbage separation and recovery machine 50. The garbage separation and recovery machine 50 is configured to be joined to the trailer hitch 11 provided to the rear portion of the vehicle through the joint 55 so as to be towable by the vehicle 1.

The vehicle body frame 51 is configured to have a single main frame 61 extending in the front-and-rear direction of the vehicle body, a sieve body support frame 62 supported at the upper side of the main frame 61, and a shield body 63 which covers the surrounding of the drum type sieve body 54 supported by the sieve body support frame 62. These elements are configured to be symmetrical in shape between the right and left sides with respect to the center C1 in the width direction of the garbage separation and recovery machine 50.

As shown in FIG. 1, the main frame 61 has a front portion 61A extending linearly rearwards from the joint 55, and a rear portion 61B extending linearly from the rear end of the front portion 61A to the rear lower side on side view. Furthermore, as shown in FIG. 3, the front portion 61A and the rear portion 61B are configured to extend linearly at the center C1 in the width direction of the vehicle body. The front portion 61A and the rear portion 61B are formed integrally with each other by bending a single metal pipe.

The front portion 61A is formed to be about several times as long as the rear portion 61B, and extends to the front side of the sieve body support frame 62 supported at the upper side of the main frame 61. An inverted T-shaped stand 61C extending downwards is provided to the front portion 61A in the neighborhood of the joint 55. When the joint 55 is detached from the vehicle 1, the stand 61C comes into contact with the ground surface and supports the main frame 61 so that the main frame 61 is floated from the ground surface.

As shown in FIGS. 2 and 3, the rear end of the rear portion 61B is provided with an axle support body 61D for supporting the axle 52 so that the axle 52 is freely rotatable. The axle support body 61D is formed by a hollow cylindrical pipe (a metal pipe in this construction) extending in the vehicle width direction, and supports the axle 52 along the vehicle width direction so that the axle 52 is freely rotatable. The axle support body 61D is provided to the width center C1 of the vehicle body to support the center portion of the axle 52.

The axle 52 is an axle that rotates integrally with the right and left wheels 53. Therefore, when the garbage separation and recovery machine 50 is towed by the vehicle 1, the axle 52 rotates at the same number of revolutions as the wheels 53 in conformity with the rotation of the wheels 53.

The sieve body support frame 62 is a frame member for supporting the drum type sieve body 54 from the lower side, and formed by assembling plural metal pipes so as to be symmetrical in shape between the right and left sides with respect to the width center C1 of the vehicle body. The sieve body support frame 62 is supported at the upper side of the main frame 61 through a support frame 65 located between the main frame 61 and the sieve body support frame 62.

As shown in FIGS. 4 and 5, the support frame 65 has a front support frame 66 provided in front of the axle 52 and a rear support frame 67 provided behind the axle 52. The front support frame 66 is constructed by plural (three in this construction) frame members extending upwards from the rear portion of the front portion 61A of the main frame 61, and the front portion of the sieve body support frame 62 is supported on the main frame 61 by the front support frame 66.

The rear support frame 67 is a frame which extends upwards from the axle support body 61D as the rear end of the main frame 61 and supports the rear portion of the sieve body support frame 62 from the lower side, and has a single frame member 67A extending from the center in the width direction of the axle support body 61D to the rear upper side, and a substantially U-shaped branch frame member 67B branching to the right and left sides from the upper end of the frame member 67A. These support frames 66 and 67 are constructed by metal pipes.

In this construction, the sieve body support frame 62 is supported to be higher than the right and left wheels 53 by the front and rear support frames 66 and 67. In this case, the position in the up-and-down direction of the sieve body support frame 62 is set to be proximate to the upper edges of the right and left wheels 53. Accordingly, the sieve body support frame 62 is provided at a low position with avoiding interference with the wheels 53, and the drum type sieve body 54 is provided at a low position so that workability is made excellent.

In FIG. 4, reference numeral 68 represents a gusset for bridging the rear portion 61B of the main frame 61 and the lower end of the rear support frame 67. The joint strength among the main frame 61, the axle support body 61D and the rear support frame 67 is enhanced by the gusset 68.

As shown in FIG. 2, the sieve body support frame 62 is configured in a rectangular frame shape and has a pair of right and left front-and-rear extension frames 62A extending in the front-and-rear direction of the vehicle body, and a pair of front and rear right-and-left extension frames 62B which extend in the right-and-left direction of the vehicle body so as to join the front ends of the front-and-rear extension frames 62A and join the rear ends thereof. The upper end of the front support frame 66 is joined to the right-and-left extension frame 62B at the front side, and the upper end of the rear support frame 67 is joined to the right-and-left extension frame 62B at the rear side.

Cylindrical members 62C extending in the up-and-down direction are bonded to the front and rear ends of the pair of right and left front-and-rear extension frames 62A, whereby the metal cylindrical members 62C extending in the up-and-down direction is disposed at the four corners existing at the front, rear, right and left sides of the sieve body support frame 62. A part of a shield body 63 intrudes into each cylindrical member 62C from the upper side to position the shield body 63 to the sieve body support frame 62.

A pair of right and left guide rollers 71 are supported on the pair of front and rear right-and-left extension frames 62B so as to be freely turnable in the front-and-rear direction so that the roller axes thereof are aligned with each other in the right-and-left direction of the vehicle body. As shown in FIG. 4, the basket-like cylindrical drum type sieve body 54 having the bottom are mounted on the four guide rollers 7 from the upper side. The cylindrical drum type sieve body 54 is disposed so that the axis line LA thereof is parallel to the vehicle width direction (see FIG. 3, 1), and supported so as to be freely rotatable around the axis line LA.

In this case, as shown in FIG. 4, the front and rear guide rollers 71 are arranged so that the lower portion of the drum type sieve body 54 is pinched from the front and rear sides by these guide rollers 71, and the frontward and rearward movement of the drum type sieve body 54 is regulated by the front and rear guide rollers 71, whereby the drum type sieve body 54 can be stably supported. The drum type sieve body 54 are merely mounted on the guide rollers 71, and thus the drum type sieve body 54 can be easily detachably mounted by lifting up the drum type sieve body 54.

As shown in FIG. 2, the drum type sieve body 54 is a large-size basket-like cylindrical part having a bottom. Garbage which is withdrawn at the beach by a publicly-known beach cleaner and mixed with sand is put into the drum type sieve body 54, the sand is dropped by rotation of the drum type sieve body 54, whereby only the garbage is left in the sieve body 54.

The drum type sieve body 54 has a metal sieve main body 81 forming a cylindrical framework portion having a bottom which is opened at one end side (the left side in this construction) and blocked by the bottom portion 54A at the other end side (the right side), and a metal mesh member 82 covering the surrounding of the sieve main body 81.

The sieve main body 81 has an opening side cylinder portion 81A which cylindrically surrounds the opening-side end portion thereof along the peripheral direction, a blocking side cylinder portion 81B which cylindrically surrounds the blocking-side end portion thereof along the peripheral direction, and an intermediate cylinder portion 81C which cylindrically surrounds the intermediate portion in the width direction of the sieve main body 81 along the peripheral direction, and these cylinder portions 81A to 81C are constructed by cylindrical metal plate members whose centers are set on the axis line LA of the drum type sieve body 54.

The cylinder portions 81A to 81C are joined to one another by plural axial-direction extension rods 84 formed of metal steel pipes or metal rods which extend in the axis line LA direction of the drum type sieve body 54, and a number of axial-direction extension rods 84 are provided to be spaced from one another in the peripheral direction. The mesh member 82 is secured from the outside of the axial-direction extension rods 84 so as to cover the outer periphery of the sieve main body 81.

As shown in FIGS. 4 and 5, a grid portion 85 obtained by assembling a metal steel pipe or a metal rod portion in a grid-like shape so as to surround the opening of the blocking side cylinder portion 81B is provided to the blocking side cylinder portion 81B, and the metal mesh member 86 is secured from the outside so as to cover the opening of the grid portion 85. The bottom portion 54A of the drum type sieve body 54 is constructed by the grid portion 85 and the mesh member 86.

As described above, the three cylinder portions (the opening-side cylinder portion 81A, the intermediate cylinder portion 81C, the blocking-side cylinder portion 81B) are arranged so as to be spaced from one another in the axis line LA direction, and the mesh member 82 covers the gaps between them. Therefore, a mesh area in which the drum type sieve body 54 functions as a sieve can be broadly secured with securing the strength. Furthermore, the bottom portion 54A is configured in a grid-like shape, and the openings in the grid-like bottom portion 54A are covered by the mesh member 86, so that the bottom 54A can be enabled to function as a sieve.

The axial-direction extension rods 84 and the grid portion 85 are members which are located inside the mesh members 82, 86 and project into the inside of the sieve main body 81. These members 84 and 85 can be enabled to function as a sand pulverizer for pulverizing lumps of sand put into the drum type sieve body 54.

As shown in FIG. 2, the opening-side cylinder portion 81 and the blocking-side cylinder portion 81B also function as sliding members with which the guide rollers 71 come into sliding contact. That is, the opening-side cylinder portion 81A and the blocking-side cylinder portion 81B have the same diameter, and extend in the axis line LA direction of the drum type sieve body 54 by a predetermined width. The outer peripheral surfaces of the guide rollers 71 come into contact with the cylinders 81A and 8B within these widths, thereby constructing the sliding faces of the rollers 71. Furthermore, a flange portion 88 protruding to the outer peripheral side is integrally provided to the inside of each of the opening-side cylinder portion 81A and the blocking-side cylinder portion 81B in the width direction, and the positional displacement in the vehicle width direction between each guide roller 71 and the drum type sieve body 54 can be regulated by the flange portions 88.

As shown in FIG. 2, the shield body 63 is formed to be symmetrical between the right and left sides with respect to the center C1 in the width direction of the vehicle body, and it is constructed by a pair of right and left side shield members 63A which are formed in an upwardly-convex U-shape at the right and left sides of the sieve body support frame 62 so as to cover the right and left sides of the drum type sieve body 54, and plural surrounding shield members 63B which extend between the pair of right and left side shield members 63A so as to cover the front side, upper side and rear side of the drum type sieve body.

The side shield members 63A are joined to the sieve body support frame 62 by bending metal pipes in U-shape and inserting both the end portions of the metal pipes into the pair of front and left cylinder members 62C located at the right and left sides of the sieve body support frame 62 from the upper side.

Furthermore, the surrounding shield members 63B bridge the gaps of the front portions, upper portions and rear portions of the pair of right and left side shield members 63A by using meal pipes, and cover the front side, upper side and lower side of the drum type sieve body 54. The surrounding shield members 63B also function as cross members for reinforcing the pair of right and left side shield members 63A.

As shown in FIGS. 2 and 5, the side shield member 63A located at the opening side (left side) of the drum type sieve body 54 out of the right and left side shield members 63A is provided with a door member 63D for freely opening/closing the inside opening of the side shield member 63A. The door member 63D has a door frame formed of a metal pipe which has substantially the same shape as the side shield member 63A and is joined to the side shield member 63A through hinges 63E (see FIG. 4) so as to be freely openable and closable. The area surrounded by the door frame is covered by a cover member such as a mesh member or the like, for example.

Therefore, the door member 63D regulates jump-out of garbage from the opening side of the drum type sieve body 54 to the outside of the vehicle, and withdrawn garbage mixed with sand can be put into the drum type sieve body 54 by opening the door member 63D. In FIGS. 2 and 5, reference numeral 63F represents a grip provided to the door member 63D.

In each figure, the shield body 63 is illustrated as being configured by only a framework structure. However, the shield body 63 may be configured so that the overall outer periphery thereof is covered by a cover member such as a mesh member or the like, whereby scattering of sand from the drum type sieve body 54 is suppressed by the shield member 63.

As described above, according to this construction, the drum type sieve body 54 is freely rotatably supported by the guide rollers 71. Therefore, the drum type sieve body 54 is rotated under the state that garbage mixed with sand is put therein, whereby the sand can be efficiently sieved and only garbage which does not pass through the mesh members 82, 84 can be left in the sieve body 54. Accordingly, only garbage such as food containers, paper waste, tobacco-ashes, etc. remaining on the beach or the like can be left. Furthermore, the drum type sieve body 54 can be rotated with relatively small force.

Furthermore, the thus-constructed garbage separation and recovery machine 50 has a mechanism portion (transmission mechanism) 91 for performing a switching operation between an automatic rotation mode in which the drum type sieve body 54 is rotated by rotational force of the wheels 53 and a manual rotation mode in which the drum type sieve body 54 is separated from the rotational force of the wheels 53 and is allowed to be manually and freely rotatable. Therefore, at a place where the soil is prepared to enable tow of the vehicle 1, the garbage separation and recovery work can be performed with the towing force of the vehicle 1 by setting the automatic rotation mode. At a rough place at which the tow of the vehicle 1 is difficult, the garbage separation and recovery work can be easily performed with human power by setting the manual rotation mode.

First, as shown in FIGS. 2 and 5, an annular metal handle 89 is secured outside the opening end portion (left side end portion) of the drum type sieve body 54 in the vehicle width direction. This handle 89 is used as a grip part which is gripped by a worker to easily manually rotate the drum type sieve body 54 under the state that the drum type sieve body 54 is allowed to be freely rotatable (corresponding to the manual rotation mode). Any person is enabled to grip the handle 89 from the outside by opening the door member 63D, that is, the manual rotation is executed under the state that the door member 63D is opened.

Figure 6:
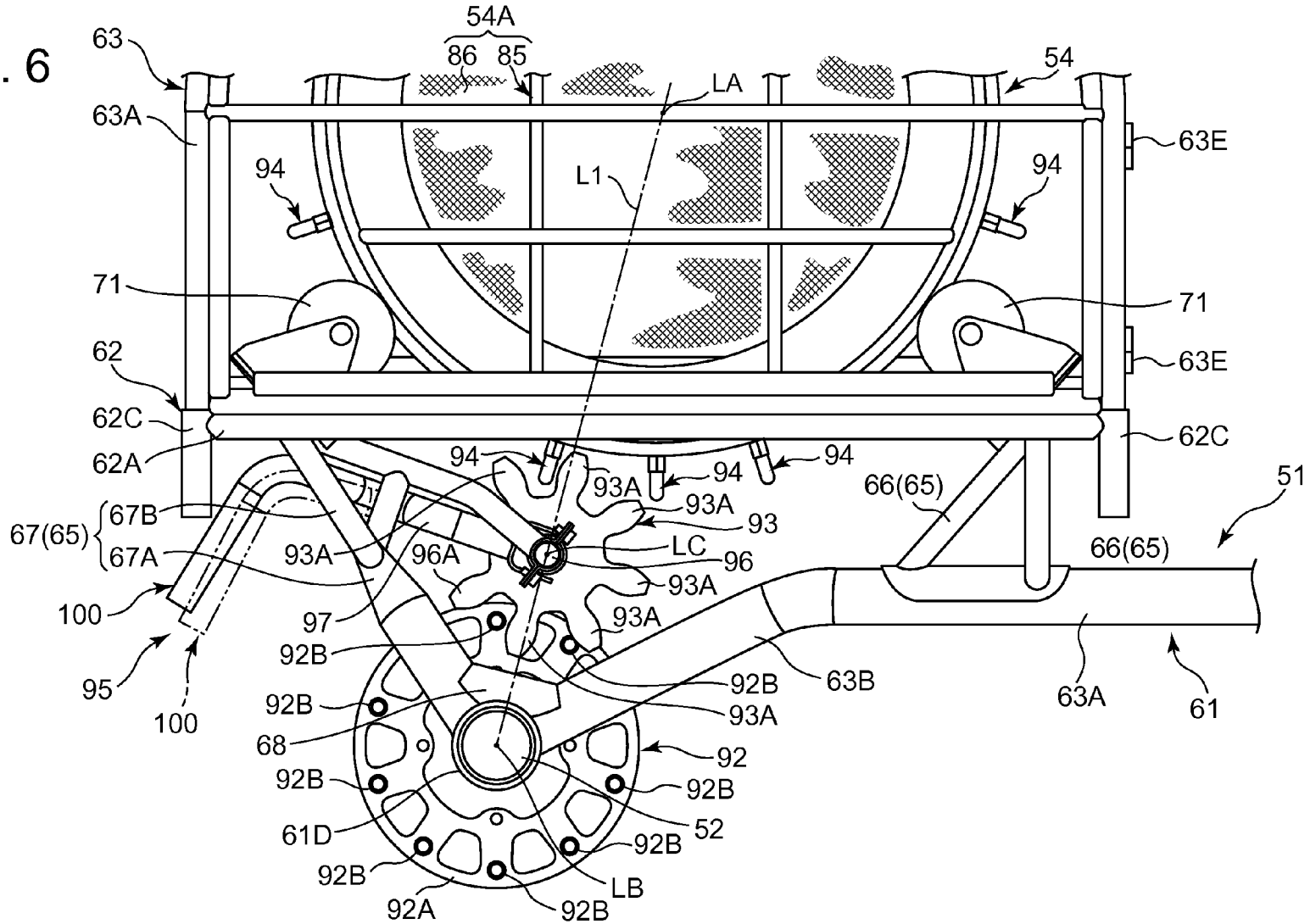
FIG. 6 is a view of a mechanism portion of the garbage separation and recovery machine which is taken from the right side together with the peripheral construction thereof.
Figure 7:
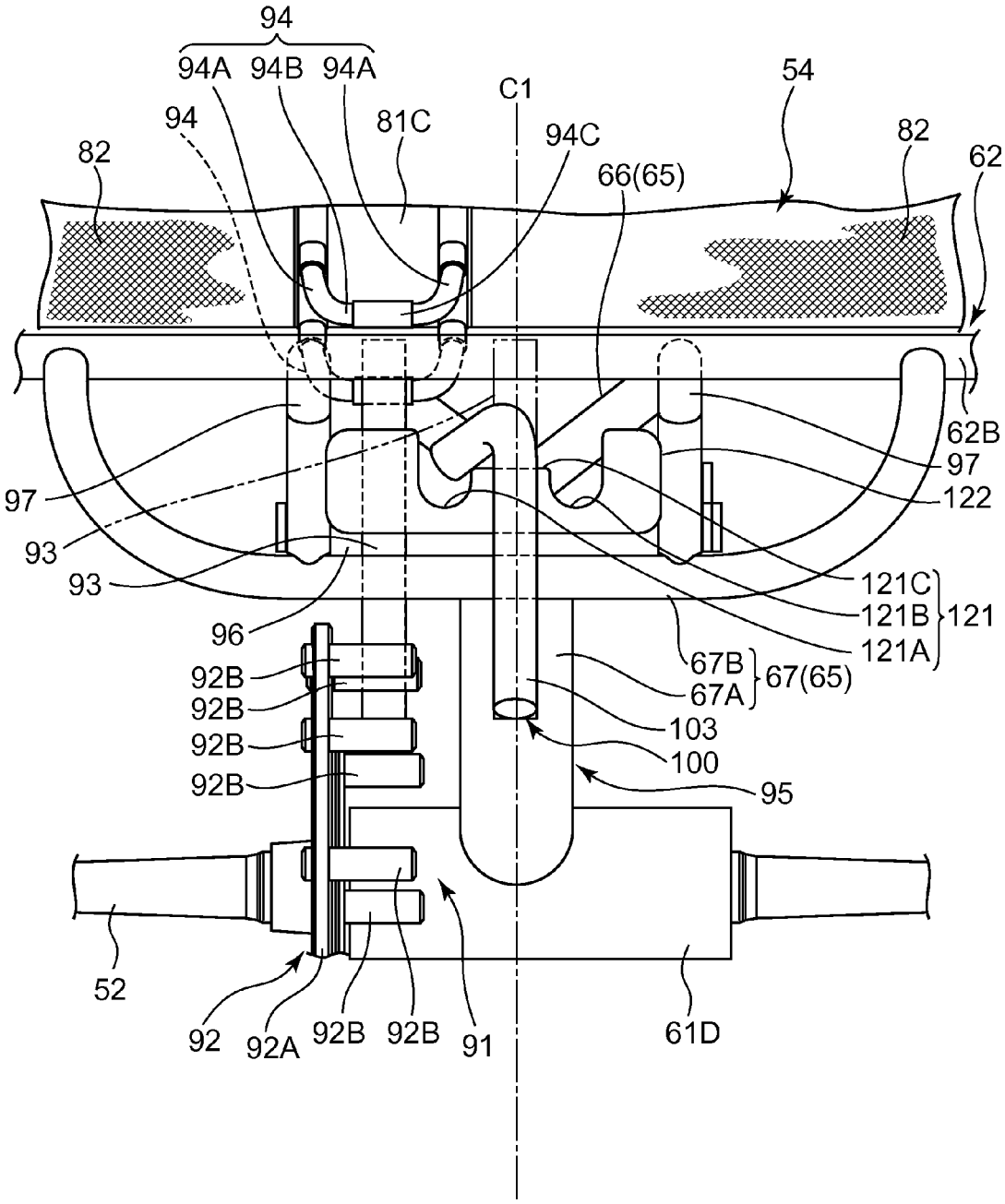
FIG. 7 is a view showing the mechanism portion together with the peripheral construction, which is taken from the rear side.

FIGS. 6 and 7 are right side and back side views of the mechanism portion 91 together with a peripheral construction thereof.

As shown in FIGS. 6 and 7, the mechanism portion 91 has a driving gear 92 secured to the axle 52, a driven gear 93 which is secured to the vehicle body frame 51 so as to be engageable with and disengageable from the driving gear 92, a fitting piece 94 which is provided o the drum type sieve body 54 and fitted to the driven gear 93 at a position where the driven gear 93 is engaged with the driving gear 92, and a gear switching mechanism (switching means) 95 for making the driven gear 93 slide to change the gear position.

The driving gear 92 is secured to be rotatable integrally with the axle 52. This driving gear 92 is provided so as to be exposed from the axle support body 61D and near to the center C1 in the width direction of the vehicle body, for example, in the neighborhood of the left end of the axle support body 61D in this construction (see FIG. 7).

Specifically, the driving gear 92 has a metal disc portion 92A expanding radially around the axle 52 in the neighborhood of the left end of the axle support body 61D, and plural rod-like members 92B which are spaced from one another in the peripheral direction of the disc portion 92A corresponding to the peripheral direction of the driving gear 92 and extend from the outer periphery of the disc portion 92A in the axial direction (right side) of the axle 52. The rod-like members 92B are configured to have the same perfectly circular cross-section and extend in a rod-like shape in the axial direction so that the tips thereof are located in the neighborhood of the center C1 in the width direction of the vehicle. Accordingly, the center of gravity of the driving gear 92 can be approached to the center C1 in the width direction of the vehicle body.

The rod-like members 92B may be formed of metal members or elastic members such as rubber or the like. When the rod-like members 92B are formed of elastic members, the contact force between the driving gear 92 and the driven gear 93 can be moderated.

As shown in FIG. 6, the driven gear 93 is mounted on a clutch pipe 96 supported on the vehicle body frame 51 so as to be freely rotatable and freely slidable in the axial direction, and the driven gear 93 is engaged with/disengaged from the rod-like members 92B of the driving gear 92 by sliding the clutch pipe 96.

Here, the disengaged state from the driving gear 92 means a state that the driven gear 93 moves to the free end side of the rod-like members 92B and moves to a position at which the driven gear 93 is perfectly retracted from the position of the rod-like members 92B. In FIG. 7, the driving gear 92 in this case is illustrated by a two-dotted chain line.

As shown in FIGS. 5 and 6, the clutch pipe 96 is a metal pipe extending linearly in parallel to the axle 52, and has such a length that the driven gear 93 is slidable between the above two positions (the engagement position and the disengagement position (or the retraction position)). The clutch pipe 96 is supported on the vehicle body frame 51 through the pair of right and left support frames 97.

The pair of right and left support frames 97 are formed of metal pipes, and the rear ends thereof are joined to the rear right and left extension frames 62B constituting the rear portion of the sieve body support frame 62 by welding or the like. The support frames 97 extend from the joint portion concerned to the lower front side in side view, and support the clutch pipe 96 in parallel to the axle 52 at the front ends thereof.

As shown in FIG. 6, the driven gear 93 has plural tooth portions 93A engaged with the rod-like members 92B of the driving gear 92 so that the tooth portions 93A are spaced from one another in the peripheral direction. These tooth portions 93A are configured in a projecting shape so as to project outwards in the radial direction from the rotational center coincident with the axis line LC of the driven gear 93. The tooth portions 93A are formed to be narrower than the interval between the adjacent rod-like members 92B of the driving gear 92 so that each of the tooth portions 93A can intrude into the gap between the adjacent rod-like members 92B with a margin.

More specifically, the base end side of each of the tooth portions 93A of the driven gear 93 gradually increases in width to the outside in the radial direction in side view, and the tip side thereof at the outside in the radial direction gradually decreases in width to the outside in the radial direction, that is, it is formed to be tapered.

As described above, the tooth portions 93A of the driven gear 93 are formed to be tapered. Therefore, the gap between the tips of the adjacent tooth portions 93A can be broadened, and the rod-like members 92B of the driving gear 92 can be easily taken in between the tooth portions 93A of the driven gear 93. Furthermore, when the rod-like member 92B of the driving gear 92 is inserted into the gap between the tooth portions 93A of the driven gear 93, the gap is gradually narrower at the base end side of the tooth portion 93A. Therefore, the gap between the tooth portion 93A of the driven gear 93 and the rod-like member 92B of the driving gear 92 can be reduced, so that they can be surely engaged with each other.

According to this construction, even under the state that sand adheres to the driven gear 93 and the driving gear 92, the driven gear 93 and the driving gear 92 can be easily and surely engaged with each other, and the sand can be easily dropped.

As shown in FIG. 6, the fitting pieces 94 are provided on the outer periphery of the intermediate cylinder portion 81C forming the intermediate framework in the axial direction of the drum type sieve body 54 so as to be arranged at regular intervals in the peripheral direction. As shown in FIG. 7, the fitting pieces 94 are U-shaped projection members projecting to the outside in the radial direction, and each of the fitting pieces 94 is formed by bending a metal pipe so as to have a pair of right and left rod-like support portions 94A projecting from the outer periphery of the sieve body 54 to the outside in the radial direction and a rod-like member (projection end) 94B which extends in the axis line LA direction so as to join the outermost ends of the pair of right and left support portions 94A integrally with each other.

In FIG. 7, reference numeral 94C represents an elastic member such as rubber or the like which is mounted so as to be wound around the outer periphery of the rod-like member 94B, and the contact impact between the fitting piece 94 and the driven gear 93 is moderated by the elastic member 94C.

As shown in FIG. 7, the rod-like members 94B of the fitting pieces 94 are located at the upper side of the rod-like members 92B of the driving gear 92, and overlapped with the rod-like members 92B of the driving gear 92 in plan view as shown in FIG. 3. The driven gear 93 is configured to freely get into and out of the gap between the rod-like members 94B of the fitting pieces 94 and the rod-like members 92B of the driving gear 92 along the clutch pipe 96. Accordingly, the lower portion of the driven gear 93 can be engaged with the rod-like members 92B of the driving gear 92, and the lower portion of the driven gear 93 can be engaged with the rod-like members 94B of the fitting pieces 94 as shown in FIG. 7.

In this case, as shown in FIG. 6, the tooth portion 93A located at the lower end of the driven gear 93 gets into the gap between the adjacent rod-like members 92B of the driving gear 92, the tooth portion 93A located at the upper end of the driven gear 93 gets into the gap between the adjacent fitting pieces 94 (the rod-like members 94B), and the drum type sieve body 54 is rotationally driven through the driven gear 93 when the driving gear 92 is rotated by the rotation of the wheel 53.

In this construction, as shown in FIG. 6, the interval between the adjacent fitting pieces 94 is set to be large to the extent that plural (two in this construction) tooth portions 93A of the driven gear 93 intrude in the gap therebetween. Accordingly, the rotation of the driven gear 93 is decelerated and transmitted to the drum type sieve body 54, whereby the rotational speed of the drum type sieve body 54 is decelerated to a desired speed suitable for sieve. Furthermore, a large gap is formed between the fitting piece 94 and the driven gear 93. Therefore, even when sand drops from the drum type sieve body 54 and adheres to the fitting pieces 94 or the driven gear 93, it does not disturb the rotation of the drum type sieve body 54 which is performed by the driven gear 93.

In addition, since the tooth portion 93A of the driven gear 93 is formed to be tapered as described above, a large gap can be secured between the tips of the adjacent tooth portions 93A, so that the fitting pieces 94 can easily intrude into this gap, the driven gear 93 and the fitting piece 94 can be easily engaged with each other, and they can be easily engaged with each other even when sand adheres.

Furthermore, in this construction, the axis line LA at the rotational center of the drum type sieve body 54 is disposed at the upper side of the axle 52 (the axis line LB) and displaced from the axle 52 (axis line LB) in the front-and-rear direction (in this construction, the axis line LA of the drum type sieve body 54 is displaced to the front side of the axle 52 (the axis line LB)), and the axis line LC at the rotational center of the driven gear 93 is disposed between the axis line LA of the drum type sieve body 54 and the axle 52 (the axis line LB) in side view.

Therefore, the driven gear 93 can be disposed by utilizing the vacant pace between the drum type sieve body 54 and the axle 52. Therefore, the mechanism portion 91 can be disposed compactly, and the drum type sieve body 54, the driven gear 93 and the axle 52 can be disposed more compactly in the up-and-down direction as compared with a case where the drum type sieve body 54, the driven gear 93 and the axle 52 are vertically arranged in the up-and-down direction.

In addition, in this construction, the axis line LC as the rotational center of the driven gear 93 is located on a line L1 for connecting the axis line LA as the rotational center of the drum type sieve body 54 and the axle 52 (the axis line LB). Therefore, the driving gear 92, the driven gear 93 and the drum type sieve body 54 can line up on the line L1, and can be efficiently arranged in proximate to one another.

Since the driven gear 93 is overlapped with the wheel 53 in side view as shown in FIG. 1, the space between the driven gear 93 and the wheel 53 can be efficiently used and the right and left sides of the driven gear 93 can be guarded by the wheels 53.

Furthermore, according to the layout of this construction, as shown in FIG. 6, the rear portion 61B of the main frame 61 is located at the front lower side of the driven gear 93, and the rear support frame 97 is located at the rear lower side, so that the driven gear 93 can be guarded from the lower side by using the existing frame member. Furthermore, the front support frame 66 is located in front of the driven gear 93, and the rear support frame 97 is located behind the driven gear 93, so that the front and rear sides of the driven gear 93 can be guarded by the support frames 66 and 67.

Next, a gear switching mechanism (switching means) 95 will be described.

Figure 8:
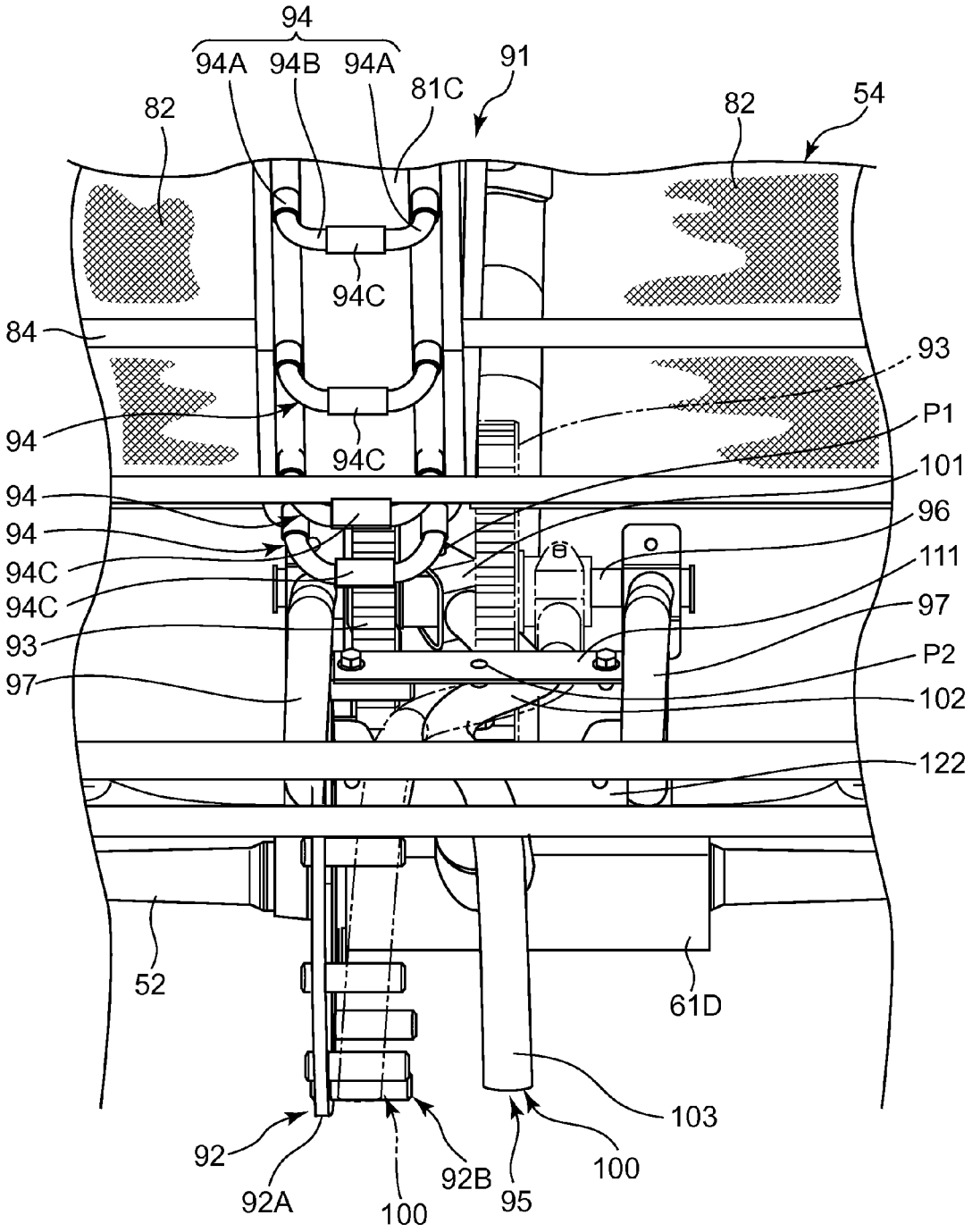
FIG. 8 is a view showing a gear switching mechanism of the garbage separation and recovery machine together with the peripheral construction, which is taken from the upper lower side.
Figure 9:
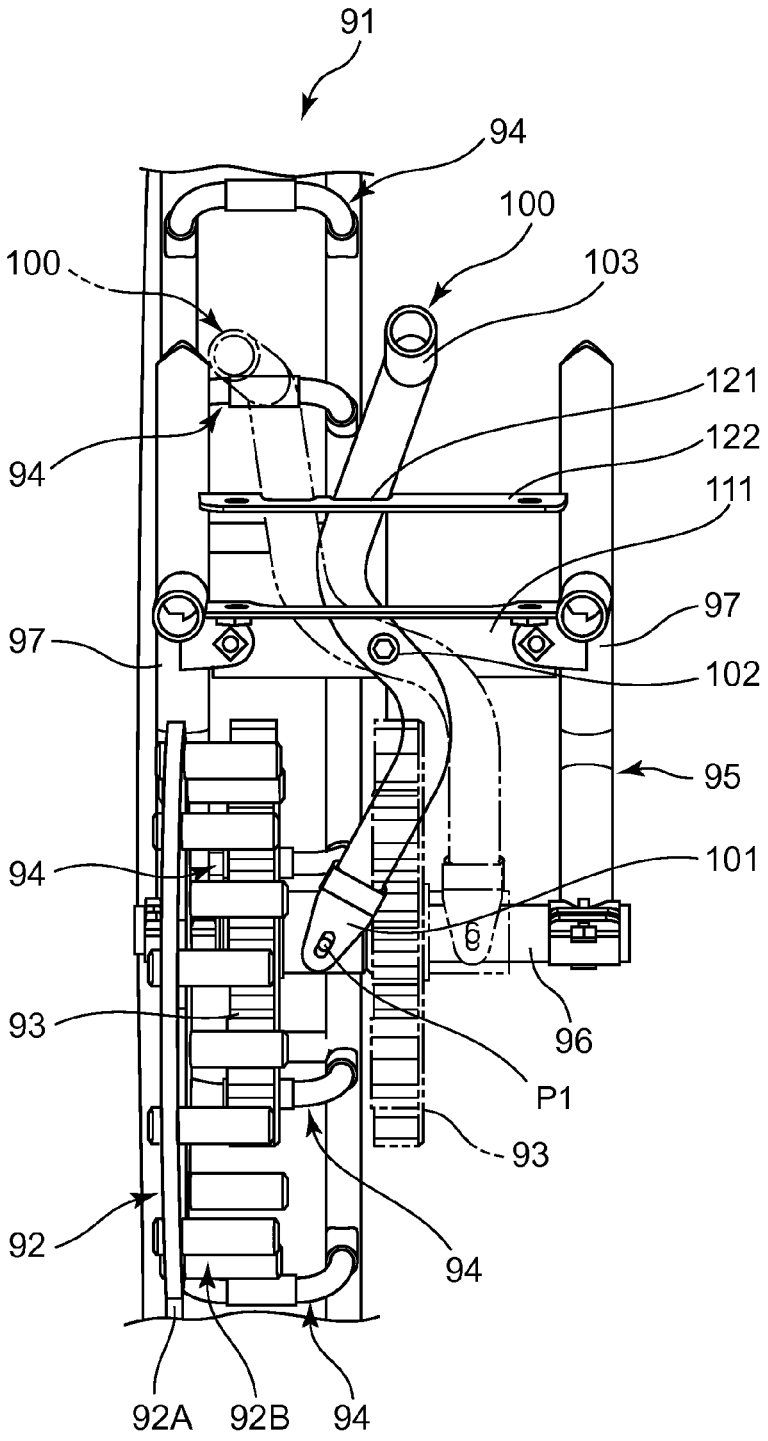
FIG. 9 is a view showing a gear switching mechanism of the gear switching mechanism together with the peripheral direction, which is taken from the lower side.

FIG. 8 is a view of the gear switching mechanism together with the peripheral construction thereof, which is taken from the rear upper side, and FIG. 9 is a view thereof taken from the lower side.

As shown in FIGS. 8 and 9, the gear switching mechanism 95 has an operation lever 100 for making the driven gear 93 slide in the axial direction of the clutch pipe 96. As shown in FIG. 9, the operation lever 100 is formed of a metal pipe which is bent in a substantially Z-shape in plan view, the tip portion 101 thereof is joined to a cylinder portion 93C integral with the driven gear 93, an intermediate portion 102 thereof is joined to a cross plate 111 bridged between a pair of right and left support frames 97 for supporting the clutch pipe 96, and a base end portion 103 thereof is downwardly bent to form a grid portion to be gripped by a worker.

Here, the joint portion between the tip portion 101 of the operation lever 100 and the driven gear 93 is an universal joint, and the operation lever 100 is joined to be freely turnable in the right-and-left direction and freely swingable in the up-and-down direction with a pin P1 (see FIG. 9) of the joint portion as a fulcrum. Furthermore, the joint portion between the intermediate portion 102 of the operation lever 100 and the cross plate 111 is an universal joint, and the operation lever 100 is joined to be freely turnable in the right-and-left direction and freely swingable in the up-and-down direction with a pin P2 (see FIG. 8) of the joint portion as a fulcrum.

Therefore, as shown in FIG. 9, when the operation lever 100 is turned in the right-and-left direction, the driven gear 93 can be moved to a position at which it is engaged with the driving gear 92 (a position indicated by a solid line) and a position at which it is not engaged with the driving gear 92 (disengagement position, a position indicated by a two-dotted chain line).

In FIGS. 8 and 9, the driven gear 93 and the operation lever 100 when the driven gear 93 is moved to the engagement position with the driving gear 92 is represented by a solid line, and the driven gear 93 and the operation lever 100 when the driven gear 93 is moved to the disengagement position is represented by the two-dotted chain line.

Furthermore, as shown in FIG. 9, a plate-like gate member 122 having a fitting groove (see FIG. 7) 121 in which the operation lever 100 is fitted is provided to the rear side of the cross plate 111 of the vehicle body frame 51.

As shown in FIG. 7, the fitting groove 121 of the gate member 122 has a pair of right and left deep groove portions 121A and 121B which extend downwardly and arranged to be spaced from each other in the right-and-left direction, and a shallow groove portion 121C through which the upper half portions of the deep groove portions 121A and 121B are linked to each other in the right-and-left direction. One side (right side) deep groove portion 121B out of the pair of right and left deep groove portions 121A and 121B is formed as a groove in which the operation lever 100 is fitted when the driven gear 93 is moved to the engagement position with the driving gear 92, and the other side (left side) deep groove portion 121A is formed as a groove in which the operation lever 100 is fitted when the driven gear 93 is moved to the disengagement position.

That is, the fitting groove 121 functions as a gate groove for guiding the operation lever 100, the driven gear 93 to the engagement position and the disengagement position, and a worker who grips the operation lever 100 moves the operation lever 100 in the right-and-left direction along the fitting groove 121, whereby the operation lever 100 can be moved to any one of the deep groove portions 121A and 121B. Furthermore, the operation lever 100 is configured so that the base end portion 103 thereof as the grip portion side is heavy, and when the worker releases his/her hold under the state that the operation lever 100 is moved to any one of the deep groove portions 121A and 121B, the operation lever 100 downwardly moves to the deep groove portion 121A, 121B by its own weight.

When the operation lever 100 is operated at the deepest portion of the deep groove portion 121A, 121B, the movement of the operation lever 100 in the right-and-left direction is regulated, whereby the operation lever 100 can be held at the engagement position or the disengagement position. Accordingly, the operation lever 100 can be easily switched between the position of the automatic rotation mode in which the drum type sieve body 54 is rotated by the rotational force of the vehicle 1 and the position of the manual rotation mode in which the drum type sieve body is released from the rotational force of the vehicle and allowed to be freely rotatable, and also held at that position. Accordingly, the operation lever 100 functions as a switching lever for switching the operation mode between the automatic rotation mode and the manual rotation mode.

As described above, the garbage separation and recovery machine 50 according to this embodiment comprises the drum type sieve body 54 having the hollow cylindrical basket-like shape having the bottom which is freely rotatably secured to the vehicle body frame 51 towed by the vehicle 1, the driving gear 92 which is freely rotatably supported on the vehicle body frame 51 and secured to the axle 52 to which the right and left wheels 53 are secured, and the mechanism portion (transmission mechanism) 91 for transmitting the driving force of the driving gear 92 to the drum type sieve body 54. The mechanism portion 91 has the driven gear 93 which is freely slidably mounted on the clutch pipe 96 provided to the vehicle body frame 51 in parallel to the axle 52 and engaged with/disengaged from the driving gear 92, the fitting pieces 94 which are provided to the outer periphery of the drum type sieve body 54 and fitted to the driven gear 93 at the position where the driven gear 93 is engaged with the driving gear 92, and the gear switching mechanism (switching means) 95 which slides the driven gear 93 to the engagement position with the driving gear 92 and retracts the driving gear 93 from the engagement position with the driving gear 92.

According to this construction, the rotation mode can be switched to the automatic rotation mode for rotating the drum type sieve body 54 with the rotational force of the wheels 53 by sliding the driven gear 93 to the engagement position with the driving gear 92 through the gear switching mechanism 95. Furthermore, the rotation mode can be switched to the manual rotation mode for manually rotating the drum type sieve body 54 by retracting the driven gear 93 from the engagement position with the driving gear 92 through the gear switching mechanism 95.

Accordingly, at a land-leveled place, the drum type sieve body 54 can be rotated by the towing force of the vehicle 1 to enable a garbage separation work, and in an irregular terrain where the drum type sieve body 54 cannot be towed by the vehicle 1, the drum type sieve body 54 can be easily manually rotated by human's power to perform the garbage separation work. Furthermore, the drum type sieve body 54 is rotated by the towing force under the towing operation of the vehicle 1, and the drum type sieve body 54 is manually rotated during stop of the vehicle 1, whereby the garbage separation work of the drum type sieve body 54 can be continued. When the drum type sieve body 54 is empty, it is set to the manual rotation mode, so that the drum type sieve body 54 can be avoided from being needlessly rotated during towing. As described above, the garbage separation work can be performed in accordance with various conditions.

In addition, the mechanism portion 91 for rotating the drum type sieve body 54 is constructed by the driving gear 92 provided to the axle 52, the driven gear 93 which is freely slidably provided to the clutch pipe 96 provided in parallel to the axle 52, and the fitting pieces 94 provided on the outer periphery of the drum type sieve body 54. Therefore, the engagement structure can be simplified, the mechanism portion 91 can be miniaturized, and the garbage separation and recovery machine 50 can be miniaturized. Accordingly, there can be provided the garbage separation and recovery machine 50 which is simple in structure and high in mobility, can withdraw and separate garbage while moving on seacoast as an irregular terrain and perform the garbage separation work in accordance with the situation by the mode switching.

In this construction, the fitting pieces 94 are configured to be spaced from one another in the peripheral direction of the drum type sieve body 54 and extend outwards in the radial direction from the outer periphery of the sieve body 54, the driving gear 92 has the plural rod-like members 92B which are spaced from one another in the peripheral direction of the gear 92 and extend in the axial direction of the axle 52 from the outer periphery of the gear, and the driven gear 93 is engaged with the rod-like members 94B as the projecting ends of the fitting pieces 94 and the rod-like members 92B of the driving gear 92. Therefore, the driven gear 93 and each of the rod-like members 94B, 92B can be easily engaged with each other, the switching operation between engagement/disengagement can be smoothly performed, and the engagement state can be held even under running on an irregular terrain such as seacoast or the like. In addition, sand is liable to drop from the rod-like members 94B, 92B, and sand is difficult to stay at the engagement portion, so that abrasion can be suppressed.

The drum type sieve body 54 is disposed above the axle 52 so that the rotational center (axis line LA) of the drum type sieve body 54 is displaced from the axle 52 in the front-and-rear direction, and the rotational center (axis line LB) of the driven gear 93 is provided between the rotational center (axis line LA) of the drum type sieve body 54 and the axle 52 in side view. Therefore, the driven gear 93 can be disposed by using the empty space between the drum type sieve body 54 and the axle 52. Accordingly, the mechanism portion 91 can be miniaturized and the garbage separation and recovery machine 50 can be miniaturized in the up-and-down direction.

Furthermore, the gear switching mechanism 95 is supported by the vehicle body frame 51 so as to be freely turnable in the axle direction with the intermediate portion 102 of the vehicle body frame 51 as a fulcrum, the driven gear 93 is joined to the tip portion 101 thereof, and the operation lever 100 which slides the driven gear 93 by turning in the axle direction is provided, so that the mode can be switched by moving the driven gear 93 with a simple structure using the single operation lever 100.

In this construction, the vehicle body frame 51 has the joint 55 secured to the trailer hitch 11 at the front end thereof, and has the main frame 61 which extends linearly backwards from the joint 55 while passing through the width center C1 of the garbage separation and recovery machine 50, further extends to the rear lower side and supports the axle 52 at the rear end thereof, the sieve body support frame 54 which is supported at the upper side of the main frame 61 and supports the drum type sieve body 54 through the guide rollers 71 so that the drum type sieve body 54 is freely rotatable, and the shield body 63 which is supported by the sieve body support frame 62 and covers the surrounding of the drum type sieve body 54. Therefore, the drum type sieve body 54 can be supported through the sieve body support frame 62 at an excellent workability place above the main frame 61 with miniaturizing the main frame 61 in the vehicle width direction and the up-and-down direction, and the drum type sieve body 54 can be covered by the shield body 63. Accordingly, the garbage separation and recovery machine 50 can be constructed with a compact frame structure.

Furthermore, in this construction, the main frame 61 has the front portion 61A extending from the joint 55 linearly backwards, and the rear portion 61B which extends from the rear end of the front portion 61A to the lower rear side and supports the axle 52 at the rear end thereof. The front portion 61A is formed to be longer than the rear portion 61B, and the driven gear 93 is disposed to be overlapped with the wheels 53 between the rear portion 61B and the drum type sieve body 54 in side view. Therefore, the drive gear 93 can be compactly disposed by using the space between the main frame 61 and the drum type sieve body 54, and also the driven gear 93 can be guarded by the rear portion 61B of the main frame 61 and the wheels 53. Furthermore, the height of the joint 55 to the axle 52 can be secured, and variation of the attitude of the garbage separation and recovery machine 50 which is caused by the difference in height of the trailer hitch 11 of the towing vehicle 1 can be suppressed.

In this construction, the support frame 65 for supporting the sieve body support frame 62 at the upper side of the main frame 61 is provided, and the support frame 65 has the front support frame 66 which extends upwards from the front portion 61A of the main frame 61 and supports the sieve body support frame 62. Therefore, the sieve body support frame 62 can be supported at a position near to the main frame 61, and the support stiffness of the drum type sieve body 54 can be secured.

Furthermore, the support frame 65 has the rear support frame 67 which extends upwards from the rear end of the main frame 61 and supports the sieve body support frame 62, and the driven gear 93 is disposed behind the front support frame 66 and in front of the rear support frame 67, so that the front and rear sides of the driven gear 93 can be guarded by the support frames 66 and 67.

<Second Embodiment>

Figure 10:
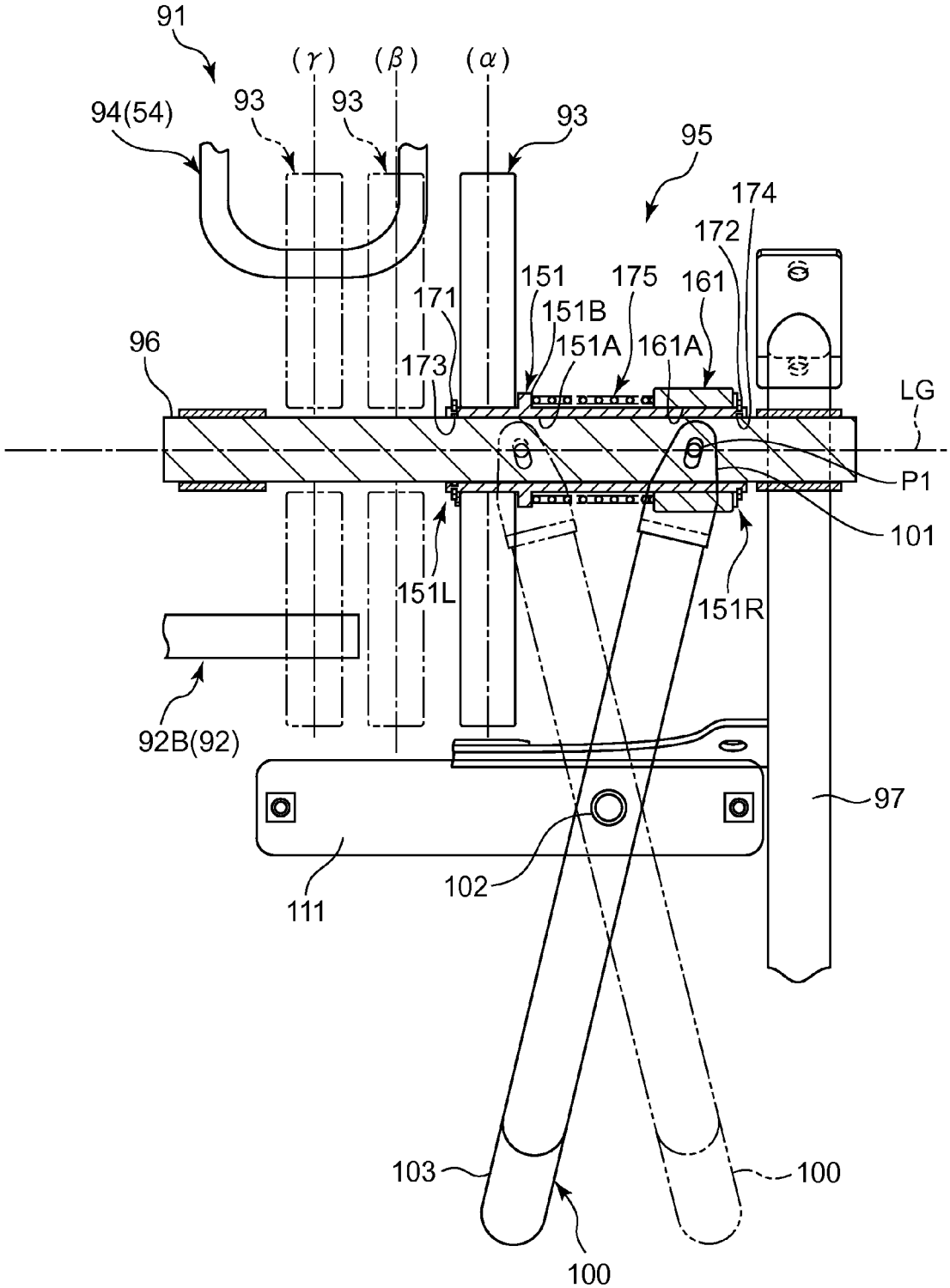
FIG. 10 is a diagram showing a garbage separation and recovery machine according to a second embodiment together with a peripheral construction.

FIG. 10 is a diagram showing a gear switching mechanism 95 of a garbage separation and recovery machine 50 according to a second embodiment. In FIG. 10, the substantially same elements as the first embodiment are represented by the same reference numerals.

As shown in FIG. 10, the clutch pipe 96 is provided with a cylindrical gear holding body 151 for holding the driven gear 93, and a cylindrical collar (sliding member) 161 to which the operation lever 100 is joined.

The gear holding body 151 is constructed by a substantially cylindrical part formed of metal or resin, and the clutch pipe 96 is inserted through a through hole 151A of the gear holding body 151 so that the gear holding body 151 is freely slidably and rotatably provided to the clutch pipe 96.

A single flange portion 151B which annularly projects outwards in the radial direction is provided between one end portion (the end portion at the left side in FIG. 10) 151L of the gear holding body 151 and the other end portion (the end portion at the right side in FIG. 10) 151R. On the basis of the flange portion 151B, the driven gear 93 is fixed to the outer peripheral surface of the one end portion 151L, and the collar 161 is freely slidably and freely rotatably provided to the outer peripheral surface of the other end portion 151R.

The one end portion 151L of the gear holding body 151 is provided with a retaining ring 171 for preventing drop-out of the driven gear 93, and the other end portion 151R is provided with a retaining ring 172 for preventing drop-out of the collar 161. As shown in FIG. 10, the retaining rings 171 and 172 and the flange portion 151B are located in the neighborhood of the driven gear 93 in the right-and-left direction. Therefore, even when large force acts on the driven gear 93 from the external, the positional displacement of the driven gear 93 can be regulated by the retaining ring 171 and the flange portion 151B.

Furthermore, a pair of shield members 173 and 174 are arranged between the gear holding body 151 and the clutch pipe 96 so as to be spaced from each other in the axial direction, and the shield members 173 and 174 prevents intrusion of sand or the like from the external into the gap between the gear holding body 151 and the clutch pipe 96.

The collar 161 is constructed by a cylindrical part formed of metal or resin which is shorter in the axial direction than the gear holding body 151, and the other end portion 151R of the gear holding body 151 penetrates through the through-hole 161A of the collar 161.

As shown in FIG. 10, the inner diameter of the collar 161 is set to be substantially equal to the outer diameter of the other end portion 151R of the gear holding body 151. The outer diameter of the collar 161 is set to be substantially equal to the outer diameter of the flange portion 151B. Therefore, the collar 161 is freely slidable and freely rotatable along the outer peripheral surface of the other end portion 151R in the rang between the flange portion 151B and the retaining wheel 172 provided to the other end portion 151R, that is, the collar 161 is freely slidable and freely rotatable along the clutch pipe 96.

The tip portion 101 of the operation lever 100 is joined to the outer peripheral portion of the collar 151 so as to be freely swingable (freely turnable) in the right-and-left and the up-and-down direction with the pin P1 as a fulcrum. Accordingly, the collar 151 is moved along the clutch pipe 96 according to the operation of the operation lever 100.

In this construction, a coil spring (urging member) 175 is interposed between the collar 151 and the flange portion 151B, and the motion of the collar 151 in the sliding direction (the motion in the axial direction of the clutch pipe 96) is transmitted to the flange portion 151B through the coil spring 175 to move the gear holding body 151 integral with the flange portion 151B. That is, the operation of the operation lever 100 is transmitted to the gear holding body 151 through the coil spring 175. In the figures, reference character LG represents the axis line of the clutch pipe 96.

As shown in FIG. 10, when the operation lever 100 is operated from a position indicated by a virtual line (two-dotted chain line) to a position indicated by a solid line in FIG. 10, the collar 161 first moves relatively to the gear holding body 151 in the right direction, and the collar 161 comes into contact with the retaining ring 172 of the gear holding body 151. Thereafter, the collar 161 and the gear holding body 151 move in the right direction integrally with each other. Therefore, as shown in FIG. 10, the collar 161 and the gear holding body 151 move to the right end portion of the clutch pipe 96 and the driven gear 93 moves to a position (disengagement position $\alpha$) at which the driven gear 93 is neither engaged with the fitting pieces 94 of the drum type sieve body 54, nor engaged with the driving gear 92.

On the other hand, when the operation lever 100 is operated to the position indicated by the virtual line (two-dotted chain line) in FIG. 10, the collar 161 first moves relatively to the gear holding body 151 in the left direction. Therefore, the coil spring 175 deflects in accordance with the movement of the collar 161, and the urging force of the coil spring 175 occurring due to this deflection acts as urging force for urging the gear holding body 151 and the driven gear 93 to the left side through the flange portion 151B.

The deflection amount is proportional to the movement amount of the collar 161. Therefore, when the urging force of the coil spring 175 occurring due to this sagging reaches force with which the gear holding body 151 can be moved, the gear holding body 151 moves to the same direction as the collar 161, and the driven gear 93 moves to a position (engagement positions $\beta$, $\gamma$ in FIG. 10) at which the driven gear 93 is engaged with the fitting pieces 94 of the drum type sieve body 54 and the driving gear 92.

Therefore, the driven gear 93 is moved to the engagement position $\beta$, $\gamma$ by the urging force of the coil spring 175 with a time lag from the lever operation.

The engagement position $\beta$ represents a position (first engagement position) at which the driven gear 93 is engaged with the fitting pieces 94 of the drum type sieve body 54, but is not engaged with the driving gear 92, and the engagement position $\gamma$ represents a position (second engagement position) at which the driven gear 93 is engaged with the fitting pieces 94 of the drum type sieve body 54 and the driving gear 92.

When the driven gear 93 is urged by the urging force of the coil spring 175, the driven gear 93 would pass through the first engagement position $\beta$ and then move to the second engagement position $\gamma$ if the driven gear 93 is located at a rotational position (phase) at which the driven gear 93 can engage with each of the fitting pieces 94 of the drum type sieve body 54 and the driving gear 92.

However, it is normally rare that the three parts of the driven gear 93, the fitting piece 94 of the drum type sieve body 54 and the driving gear 92 are aligned with one another at such a rotational position (phase) that they are engageable with one another in accordance with the operation timing of the operation lever, and it is difficult to make the driven gear 93 engage with each of the fitting piece 94 of the drum type sieve body 54 and the driving gear 92 by only adjusting the timing of the lever operation.

Particularly, this construction has a simple structure having no mechanism for rotationally synchronizing the driven gear 94 with the fitting pieces 94 and the driving gear 92, and it is more difficult to engage the respective parts with one another.

However, this construction has the coil spring 161 for urging the driven gear 93 to the engagement positions β, γ according to the operation of the operation lever 100. Therefore, when the driven gear 93 is not at the rotational positions (phase) at which it is engageable with each of the fitting piece 94 of the drum type sieve body 54 and the driving gear 92, the driven gear 93 comes into contact with the side surface of any one of the fitting piece 94 and the driving gear 92 and stops movement of the fitting piece 94 or the driving gear 92. However, the driven gear 93 is kept to be urged by the coil spring 161, and thus the driven gear 93 is immediately pushed out and moved to the engagement positions β, γ by the urging force of the coil spring 161 when the driven gear 93, the fitting piece 94 and the driving gear 92 are set in phase to be engageable with one another, whereby the driven gear 93 can be engaged with each of the fitting piece 94 and the driving gear 92.

Therefore, by fixing the operation lever 100 to the position indicated by the virtual line (two-dotted chain line), the driven gear 93 can be operated and engaged with the fitting piece 94 and the driving gear 92 immediately irrespective of the timing of the lever operation when the timing at which they are in phase with one another comes.

Furthermore, in this construction, the fitting pieces 94 of the drum type sieve body 54 are configured to extend to the driven gear 93 side located at the disengagement position α as compared with the driving gear 92.

Therefore, when the driven gear 93 is moved from the disengagement position α in the left direction in FIG. 10, the driven gear 93 is first on standby in contact with the side surface of the fitting piece 94 until it is allowed to be engaged with the fitting piece 94 of the drum type sieve body 54 (until they are set in phase). The driven gear 93 and the fitting piece 94 are immediately engaged with each other (at the first engagement position β) by the urging force of the coil spring at the timing when they are set in phase. Subsequently, the driven gear 93 is on standby in contact with the side surface of the driving gear 92 until it is allowed to be engaged with the driving gear 92 (until they are set in phase), and they are immediately engaged with each other (at the second engagement position γ) by the urging force of the coil spring 175 at the timing when they are set in phase.

That is, in this construction, the driven gear 93 has the engagement position (the first engagement position α) with one of the driving gear 92 and the fitting piece 94 between the engagement position with and the disengagement position from both the driving gear 92 and the fitting piece 94 (between the disengagement position α and the second engagement position γ). After the driven gear 93 is engaged with one of the driving gear 92 and the fitting piece 94 (that is, the fitting piece 94), the driven gear 93 is engaged with the other (the driving gear 92) while the above engagement state is maintained.

Therefore, the driven gear 93 is engaged with each of the fitting gear 94 and the driving gear 92 with a time lag. Therefore, as compared with a case where the driven gear 93 is engaged with both the members (the fitting piece 94 and the driving gear 92) at the same timing, the driven gear 93 can be more easily engaged with both the members. Accordingly, the engagement can be more quickly performed.

As described above, according to this embodiment, the color (sliding member) 161 which slides along the clutch pipe 96 in accordance with the operation of the operation lever 100 is provided, and the coil spring (urging member) 175 for urging the driven gear 93 to the engagement position is provided between the collar 161 and the driven gear 93. Therefore, when the driven gear 93 is engaged, the driven gear 93 is made to be on standby until the phase of the driven gear 93 is matched, and it can be quickly and easily engaged by the urging force when the phase is matched.

Accordingly, the switching operation between the automatic rotation mode and the manual rotation mode can be easily and quickly performed under the state that the wheels 53 are rotated. Another urging member may be used in place of the coil spring 175.

Furthermore, in this construction, after the driven gear 93 is engaged with one (the fitting piece 94), the driven gear 93 is engaged with the other (the driving gear 92) while the above state is kept. Accordingly, the driven gear 93 can be more easily and quickly engaged.

Still furthermore, the joint mechanism for joining the operation lever 100 and the driven gear 93 is constructed by the collar 161, the coil spring 175 and the cylindrical gear holding body 151 for holding the driven gear 93. Therefore, the number of parts is small, and the three parts described above are insertion parts through which the clutch pipe 96 is inserted. Therefore, the extension amounts of these parts from the clutch pipe 96 are small, and thus the whole body can be miniaturized.

The above-described embodiment is merely an example of the present invention, and any modification and application may be made without departing from the subject matter of the present invention.

For example, in the above embodiment, the rotational center (axis line LA) of the drum type sieve body 54 is disposed to be displaced to the front side of the axle 52, and the rotational center (LC) of the driven gear 93 is provided between the rotational center (axis line LA) of the drum type sieve body 54 and the axle 52. However, the present invention is not limited to this embodiment. The rotational center (axis line LA) of the drum type sieve body 54 may be disposed to be displaced to the rear side of the axle 52, and the rotational center (LC) of the driven gear 93 may be provided between the rotational center (axis line LA) of the drum type sieve body 54 and the axle 52. In this case, the garbage separation and recovery machine 50 can be configured to be more compact in the up-and-down direction as compared with the case where the drum type sieve body 54, the driven gear 93 and the axle 52 are arranged vertically in the up-and-down direction.

Still furthermore, in the above embodiment, the driven gear 93 is engaged with the fitting piece 94 of the drum type sieve body 54 and then engaged with the driving gear 92. However, the driven gear 93 may be engaged with the fitting piece 94 after engaged with the driving gear 92. In this case, they are engaged with one another with a time lag, and thus the engagements can be easily performed.

Figure 11:
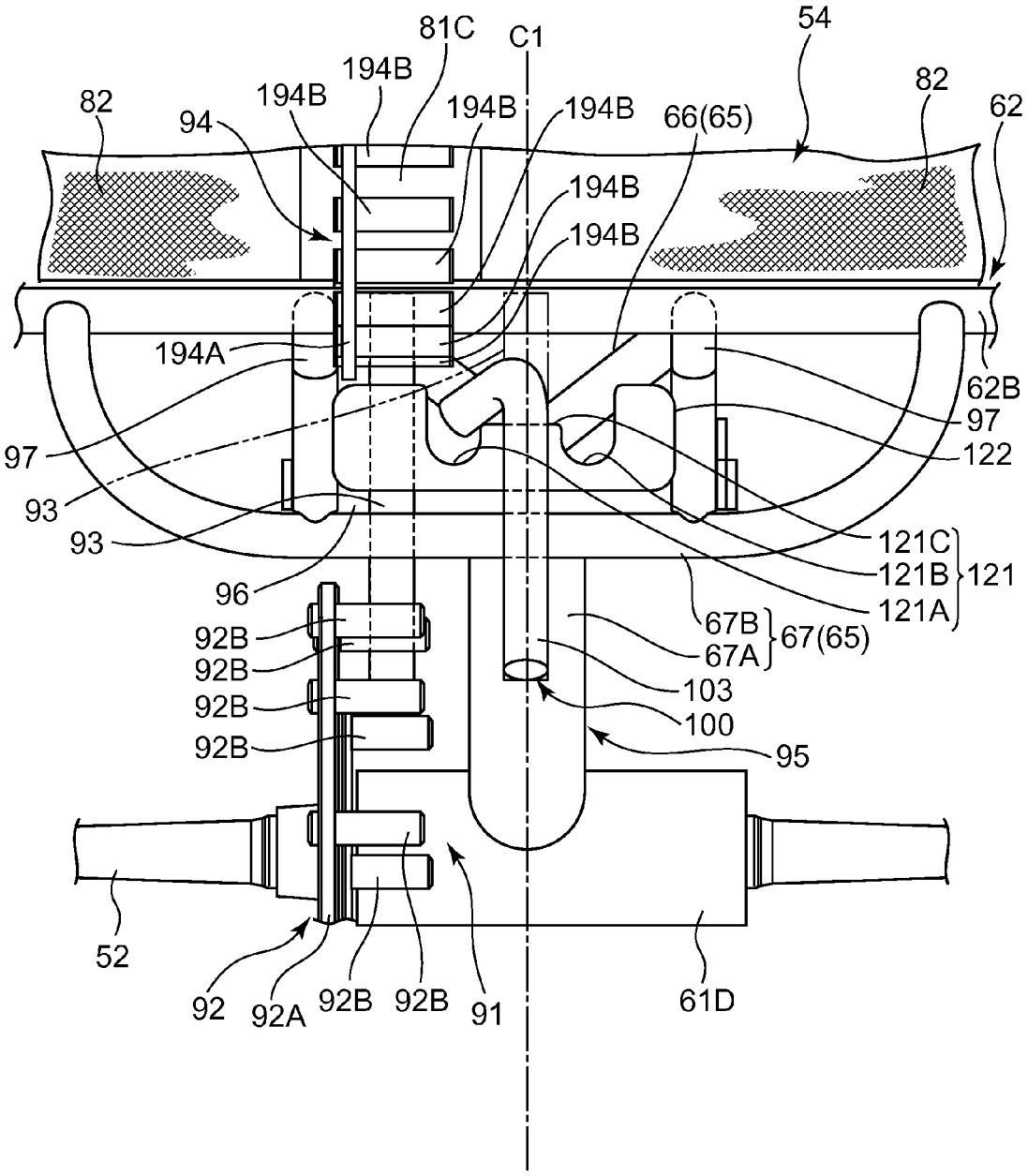
FIG. 11 is a diagram showing a gear switching mechanism according to a modification.

In the above embodiment, the fitting piece 94 of the drum type sieve body 54 is formed in U-shape. However, the present invention is not limited to this style. For example, as shown in FIG. 11, a metal disc portion 194A which is configured to increase in diameter around the rotation axis of the drum type sieve body 54 may be provided in the neighborhood of the left end of the drum type sieve body 54, and plural rod-like members 194B extending from the outer periphery of the disc portion 194A in the axial direction (to the right side) of the rotational axis are provided to be spaced from one another in the peripheral direction of the disc portion 194. According to this construction, sand is liable to drop from the rod-like members 194B, and sand hardly stays at the engagement portion between the driven gear 92 and each rod-like member 194B, so that abrasion can be suppressed.

Furthermore, in the above embodiment, the garbage separation and recovery machine 50 is constructed by a metal material such as a metal pipe or the like. However, the present invention is not limited to this style, and the garbage separation and recovery machine 50 may be manufactured by using another rigid material such as resin material or the like in place of the metal material.

In the above embodiment, the present invention is applied to the garbage separation and recovery machine 50 shown in FIG. 1. However, the present invention is not limited to this style, and it may be broadly applied to a garbage separation and recovery machine 50 for beach cleaning for separating sand and garbage. It is needless to say that the garbage separation and recovery machine 50 may be used at a place other than the beach.

DESCRIPTION OF REFERENCE NUMERALS

1 vehicle
50 garbage separation and recovery machine for beach cleaning
51 vehicle body frame
52 axle
53 wheel
54 drum type sieve body
55 joint
61 main frame
61A front portion
61B rear portion
62 sieve body support frame
63 shield body
65 support frame
66 front support frame
67 rear support frame
71 guide roller
91 mechanism portion (transmission mechanism)
92 driving gear
92B, 94B rod-like member
93 driven gear
94 fitting piece
95 gear switching mechanism (switching means)
96 clutch pipe
161 collar (sliding member)
175 coil spring (urging member)
C1 width center of garbage separation and recovery machine
LA axis line (rotational center) of drum type sieve body
LB axis line (rotational center) of axle
LC axis line (rotational center) of driven gear

The invention claimed is:

1. A garbage separation and recovery machine for beach cleaning that has a vehicle body frame (51) towed by a vehicle and right and left wheels (53) secured to an axle (52) supported freely rotatably by the vehicle body frame (51), and separates sand and garbage from each other, comprising:

a drum type sieve body (54) that is freely rotatably secured to the vehicle body frame (51);

a driving gear (92) secured to the axle (52);

a transmission mechanism (91) that transmits driving force of the driving gear (92) to the drum type sieve body (54), wherein the transmission mechanism (91) has switching means (95) that is configured to perform a switching operation between an automatic rotation mode in which the drum type sieve body (54) is rotated by rotational force of the wheel (53) and a manual rotation mode in which the drum type sieve body (54) is released from the rotational force of the wheel (53) and allowed to be manually freely rotatable;

a clutch pipe (96) mounted relative to the vehicle body frame (51) in parallel relative to the axle (52);

a sliding member (161) positioned on the clutch pipe (96), said sliding member (161) being operatively connected to an operation lever (100) to be slidable in an axial direction relative to the clutch pipe (96) in accordance with the manual operation of the operation lever (100);

a driven gear (93) mounted on the sliding member (161); and an urging member (175) operatively mounted between the sliding member (161) and the driven gear (93) for normally urging the driven gear (93) in the axial direction to an engaging position with the driving gear (92).

2. The garbage separation and recovery machine for beach cleaning according to claim 1, wherein the driven gear (93) is freely slidably mounted relative to the clutch pipe (96) and engaged with/disengaged from the driving gear (92), and fitting pieces (94) that are provided on the outer periphery of the drum type sieve body (54) and engaged with the driven gear (93) at a position where the driven gear (93) is engaged with the driving gear (92), wherein the automatic rotation mode and the manual rotation mode are switched to each other by sliding the driven gear (93) to an engagement position where the driven gear (93) is engaged with the driving gear (92) and a disengagement position where the driven gear (93) is disengaged from the driving gear (92) while retracted from the engagement position with the driving gear (92).

3. The garbage separation and recovery machine for beach cleaning according to claim 2, wherein the fitting pieces (94) are spaced from one another in the peripheral direction of the drum type sieve body (54) and project outwards in the radial direction from the outer periphery of the sieve body, the driving gear (92) has a plurality of rod-like members (92B) that are spaced from one another in the peripheral direction of the gear and extend in the axial direction of the axle (53) from the outer periphery of the gear, and the driven gear (93) is engaged with projection ends of the fitting pieces (94) and the rod-like members (92B).

4. The garbage separation and recovery machine for beach cleaning according to claim 2, wherein the drum type sieve body (54) is disposed at the upper side of the axle (52) so that the rotational center of the drum type sieve body (54) is displaced from the axle (52) in a front-and-rear direction, and the rotational center of the driven gear (93) is provided between the rotational center of the drum type sieve body (54) and the axle (52) in side view.

5. The garbage separation and recovery machine for beach cleaning according to claim 2, wherein the switching means (95) has the operation lever (100) is supported by the vehicle body frame (51) so as to be freely turnable and being joined adjacent to the driven gear (93) at a tip portion thereof to slide the driven gear (93) in the axial direction.

6. The garbage separation and recovery machine according to claim 5, wherein the driven gear (93) is engaged with one of the driving gear (92) and each of the fitting pieces (94), and then is engaged with the other with keeping an engagement state with the one.

7. The garbage separation and recovery machine for beach cleaning according to claim 2, wherein the vehicle body frame (51) has a joint (55) secured to a trailer hitch (11) at a front end thereof, a main frame (61) that passes from the joint (55) through a width center of the vehicle body, extends linearly backwards and further extends to a lower rear side to support the axle (52) at a rear end thereof, a sieve body support frame (62) that is supported at an upper side of the main frame (61) and supports the drum type sieve body (54) through a roller (71) so that the drum type sieve body (54) is freely rotatable, and a shield body (63) that is supported by the sieve body support frame (62) and covers the surrounding of the drum type sieve body (54).

8. The garbage separation and recovery machine for beach cleaning according to claim 7, wherein the main frame (61) has a front portion (61A) extending linearly from the joint (55) backwards, and a rear portion (61B) that extends from a rear end of the front portion (61A) to a rear lower side and supports the axle (52) at a rear end thereof, the front portion (61*a*) is formed to be longer than the rear portion (61B), and the driven gear (93) is disposed to be overlapped with the wheel (53) between the rear portion (61B) and the drum type sieve body (54) in side view.

9. The garbage separation and recovery machine for beach cleaning according to claim 8, further comprising a support frame (65) that supports the sieve body support frame (62) at an upper side of the main frame (61), wherein the support frame (65) has a front support frame (66) that extends upwards from the front portion (61A) of the main frame (61) and supports the sieve body support frame (62).

10. The garbage separation and recovery machine for beach cleaning according to claim 9, wherein the support frame (65) has a rear support frame (67) that extends upwards from a rear end of the main frame (61) and supports the sieve body support frame (62), and the driven gear (93) is disposed behind the front support frame (66) and in front of the rear support frame (67).

11. The garbage separation and recovery machine for beach cleaning according to claim 3, wherein the drum type sieve body (54) is disposed at the upper side of the axle (52) so that the rotational center of the drum type sieve body (54) is displaced from the axle (52) in a front-and-rear direction, and the rotational center of the driven gear (93) is provided between the rotational center of the drum type sieve body (54) and the axle (52) in side view.

12. The garbage separation and recovery machine for beach cleaning according to claim 3, wherein the switching means (95) has the operation lever (100) supported by the vehicle body frame (51) so as to be freely turnable and being joined adjacent to the driven gear (93) at a tip portion thereof to slide the driven gear (93) in the axial direction.

13. The garbage separation and recovery machine for beach cleaning according to claim 4, wherein the switching means (95) has the operation lever (100) supported by the vehicle body frame (51) so as to be freely turnable and being joined adjacent to the driven gear (93) at a tip portion thereof to slide the driven gear (93) in the axial direction.

14. The garbage separation and recovery machine for beach cleaning according to claim 3, wherein the vehicle body frame (51) has a joint (55) secured to a trailer hitch (11) at a front end thereof, a main frame (61) that passes from the joint (55) through a width center of the vehicle body, extends linearly backwards and further extends to a lower rear side to support the axle (52) at a rear end thereof, a sieve body support frame (62) that is supported at an upper side of the main frame (61) and supports the drum type sieve body (54) through a roller (71) so that the drum type sieve body (54) is freely rotatable, and a shield body (63) that is supported by the sieve body support frame (62) and covers the surrounding of the drum type sieve body (54).

15. The garbage separation and recovery machine for beach cleaning according to claim 4, wherein the vehicle body frame (51) has a joint (55) secured to a trailer hitch (11) at a front end thereof, a main frame (61) that passes from the joint (55) through a width center of the vehicle body, extends linearly backwards and further extends to a lower rear side to support the axle (52) at a rear end thereof, a sieve body support frame (62) that is supported at an upper side of the main frame (61) and supports the drum type sieve body (54) through a roller (71) so that the drum type sieve body (54) is freely rotatable, and a shield body (63) that is supported by the sieve body support frame (62) and covers the surrounding of the drum type sieve body (54).

16. The garbage separation and recovery machine for beach cleaning according to claim 5, wherein the vehicle body frame (51) has a joint (55) secured to a trailer hitch (11) at a front end thereof, a main frame (61) that passes from the joint (55) through a width center of the vehicle body, extends linearly backwards and further extends to a lower rear side to support the axle (52) at a rear end thereof, a sieve body support frame (62) that is supported at an upper side of the main frame (61) and supports the drum type sieve body (54) through a roller (71) so that the drum type sieve body (54) is freely rotatable, and a shield body (63) that is supported by the sieve body support frame (62) and covers the surrounding of the drum type sieve body (54).

17. The garbage separation and recovery machine for beach cleaning according to claim 6, wherein the vehicle body frame (51) has a joint (55) secured to a trailer hitch (11) at a front end thereof, a main frame (61) that passes from the joint (55) through a width center of the vehicle body, extends linearly backwards and further extends to a lower rear side to support the axle (52) at a rear end thereof, a sieve body support frame (62) that is supported at an upper side of the main frame (61) and supports the drum type sieve body (54) through a roller (71) so that the drum type sieve body (54) is freely rotatable, and a shield body (63) that is supported by the sieve body support frame (62) and covers the surrounding of the drum type sieve body (54).

18. A garbage separation and recovery machine for beach cleaning that has a vehicle body frame (51) towed by a vehicle and right and left wheels (53) secured to an axle (52) supported freely rotatably by the vehicle body frame (51), and separates sand and garbage from each other, comprising:

a drum type sieve body (54) that is freely rotatably secured to the vehicle body frame (51);

a driving gear (92) secured to the axle (52);

a transmission mechanism (91) that transmits driving force of the driving gear (92) to the drum type sieve body (54), wherein the transmission mechanism (91) has switching means (95) that is configured to perform a switching operation between an automatic rotation mode in which the drum type sieve body (54) is rotated by rotational force of the wheel (53) and a manual rotation mode in which the drum type sieve body (54) is released from the rotational force of the wheel (53) and allowed to be manually freely rotatable;

a clutch pipe (96) mounted relative to the vehicle body frame (51) in parallel relative to the axle (52);

a sliding member (161) positioned on the clutch pipe (96), said sliding member (161) being operatively connected to an operation lever (100) to be slidable in an axial direction relative to the clutch pipe (96) in accordance with the manual operation of the operation lever (100);

a driven gear (93) mounted on the sliding member (161);

an urging member (175) operatively mounted between the sliding member (161) and the driven gear (93) for normally urging the driven gear (93) in the axial direction to an engaging position with the driving gear (92), wherein the driven gear (93) is freely slidably mounted relative to the clutch pipe (96) and engaged with/disengaged from the driving gear (92); and fitting pieces (94) mounted on the outer periphery of the drum type sieve body (54) and engaged with the driven gear (93) when the driven gear (93) is engaged with the driving gear (92).

* * * * *